US005813443A

United States Patent [19]

Dalhart et al.

[11] Patent Number: 5,813,443

[45] Date of Patent: Sep. 29, 1998

[54] VAPOR RECOVERY FUEL NOZZLES

[75] Inventors: Mark D. Dalhart, Hamilton; Paul B. Anderson, Cincinnati; David A. Damico, Lebanon, all of Ohio

[73] Assignee: Dover Corporation, New York, N.Y.

[21] Appl. No.: 986,521

[22] Filed: Dec. 7, 1992

[51] Int. Cl.[6] ..... B65B 1/04

[52] U.S. Cl. ..... 141/206; 141/59; 141/392

[58] Field of Search ..... 141/59, 302, 44–46, 141/392, 206–211, 214, 215, 217–218, 225–228, 301; 138/113, 114, 115

[56] References Cited

U.S. PATENT DOCUMENTS 5,289,856 3/1994 Strock et al. ..... 141/59
5,363,889 11/1994 Simpson et al. ..... 141/208

*Primary Examiner*—J. Casimer Jacyna
*Assistant Examiner*—Steven O. Douglas
*Attorney, Agent, or Firm*—Kinney & Schenk

[57] ABSTRACT

A vacuum assisted, vapor recovery fuel nozzle comprising a nozzle body and a spout mounted thereon. The spout comprises an inner tube and an outer tube. The inner tube and passage means in the body provide a fuel passage. The inner and outer tubes define a vapor return passage in the spout. The inner end of the outer tube is provided with a radial flange, which is clamped, by a breakaway nut, on the nozzle body to mount the spout thereon. The nozzle is provided with an automatic shut off mechanism, which includes a venturi valve for generating a negative pressure. In the absence of an overfill condition, this negative pressure is vented to atmosphere through a vent tube disposed in the vapor return passage. A normally closed vapor return valve, mounted on the nozzle body, is opened in response to the nozzle's flow control valve, so that vapors will be drawn into the entrance of the vapor return passage at the outer end of the spout. The spout is formed by telescoping the inner tube into a ferrule and the ferrule into the outer tube to provide a reenforced outer end for the spout. The nozzle body is compositely formed by a body member, a vapor cap and housing means for a main valve trip mechanism. The coaxial hose is attached to the hand grip of the nozzle at a downward angle. An optional, vestigial shroud is provided to prevent escape of vapors during delivery of fuel.

11 Claims, 13 Drawing Sheets

4
79
88
56
72
83
70
26
52
64
46
-28-
60
54
62
61
66
3
68
58
48
26'
60'
54'
58'

VAPOR RECOVERY FUEL NOZZLES

The present invention relates to improvements in vacuum assisted, vapor recovery fuel nozzles and in certain aspects finds utility in other vapor recovery nozzles, as well as non vapor recovery fuel nozzles.

A significant source of atmospheric contamination exists in the filling of vehicle fuel tanks. As such tanks are filled with fuel, vapors are generated and displaced from the tank into the atmosphere. This has led to the development of what are commonly referenced as vapor recovery fuel systems, in which fuel vapors, displaced during the filling of a vehicle fuel tank, are captured and returned to the storage tank from which the fuel is being delivered.

Such systems for vapor recovery comprise a fuel nozzle, connected by a hose to a fuel dispenser and then to a pressurized fuel source. The nozzle comprises a valve controlled, fuel passage which terminates in a spout that is inserted into a fuel tank fill pipe for the delivery of fuel. Vapor return passageway means of the nozzle extend from the spout, through the nozzle, to a hose which extends to the dispensing unit and then back to the storage tank.

There are two principal vapor recovery systems. viz., balance systems and vacuum assisted systems.

In a balance system, a seal is effected between the fill pipe and the inlet end of the vapor return passageway means. Fuel introduced into vehicle tank displaces vapors into the vapor return passageway means, while fuel drawn from the storage tank creates a partial vacuum in the storage tank and a pressure differential which induces return flow of the vapors to the storage tank. Since the storage tank, in the usual case, is disposed underground, gravity assists this return flow of fuel vapors.

In vacuum assisted systems, a vacuum pump creates a negative pressure in the vapor return passageway means to cause vapors, displaced from the fuel tank, to be drawn into the inlet end of the return passageway means and flow back to the storage tank. In the usual case, the vapors are returned to the storage tank.

In balance systems, the accepted method of forming the inlet portion of the return passageway means has been to provide a bellows which is telescoped over a central fuel spout and defines an annular vapor return passageway, along the length of the spout. The bellows is compressed to seal its outer end against the fill pipe. Considerable force is required to compress the bellows to a point where there is an assurance that an effective seal has been obtained with the fill pipe. The result is that balance system fuel nozzles are relatively heavy and require some measure of strength to obtain the necessary seal.

An advantage of the vacuum assisted system is that it eliminates the need for effecting a "mechanical" seal between the inlet end of the vapor return passageway means and the fuel tank fill pipe. This means that the inlet portion of the vapor return passageway means may be defined by a simple tube, which is telescoped over a central, inner tube, that defines the spout fuel passage. The inner and outer tubes are, generally, radially spaced to define the spout, vapor return passage. Inlet openings for the annular return passage, thus defined, are provided adjacent the outer end of the fuel spout, which is inserted into the fill pipe. Since there is a negative pressure in the vapor return passageway means, vapors, displaced from the fuel tank, will be drawn through the entrance into the annular return passage and thus prevented from escaping into the atmosphere. The need for effecting a positive mechanical seal with the fill pipe is thus eliminated. Vacuum assisted, vapor recovery nozzles are, therefore, lighter in weight and capable of use in essentially the same fashion as conventional, non-vapor recovery nozzles.

A desirable, and commercially essential, feature for fuel dispensing nozzles is the provision of automatic shut off means for interrupting delivery of fuel to prevent fuel from overflowing the fill pipe. Automatic shut off means are well known in conventional non vapor recovery nozzles. Generally speaking such means comprise a venturi valve, disposed downstream of the nozzle's control valve, which generates a negative pressure in response to fuel flow. The control valve is opened by a lever which is pivoted on a trip stem. In normal use, the venturi is vented to atmosphere through a tube that extends to the outer end of the fuel spout. When fuel rises in the fill pipe, to close off this tube, a substantial negative pressure is generated. This negative pressure is effective, through a trip mechanism diaphragm, to unlatch the trip stem and cause the control valve to close.

Another desirable, if not essential, feature of vacuum assisted vapor recovery nozzles is the provision of a valve for sealing the vapor return passage, when fuel is not being delivered. Such a valve minimizes escape of fuel vapors when the nozzle is not in use and the vacuum pump shut down. Also, where multiple dispensing units are connected to a vacuum manifold, served by a single vacuum pump, the provision of such a valve minimizes the air drawn into the system, when only a single, or limited number of dispensing units are in use.

U.S. Pat. No. 4,199,012—Lasater illustrates a vacuum assisted, vapor recovery nozzle, as generally characterized above. Lasater additionally illustrates a conventional, automatic shut off system, wherein a venturi valve which generates a negative pressure in a vacuum chamber in response to fuel flow. The vacuum chamber is connected to atmosphere by a venting tube which extends through the inner spout tube, that defines the spout, fuel passage.

U.S. Pat. No. 4,429,725 Walker, et al. teaches a vacuum assisted vapor recovery nozzle which incorporates a valve for closing the vapor return passage when the nozzle is not in use. More specifically, the inlet portion of the vapor return passage is formed by an outer tube spaced from an inner fuel spout. The inner end of the this inlet portion communicates with a chamber in the nozzle body, which is in communication with the remainder of the vapor return passageway means. The outlet from this chamber to the remainder of the vapor return passageway means is controlled by a normally closed check valve. This valve is opened in response to opening of the control valve and the resultant pressure of fuel acting on a diaphragm to which the valve is attached. The venturi, employed for the automatic shut off feature is then in communication with this chamber. The venturi is thus vented to atmosphere (preventing release of the trip stem) through the same passageway that provides the vapor return passageway means. When fuel enters the inlet to the vapor return passage, as when the level of fuel in the fill pipe reaches the level of the spout, fuel is entrained into the vapor return passage and ultimately into the check valve to the end that the venturi is no longer vented. Thereupon, there is an increase in the vacuum pressure, which causes release of the trip stem and a resultant closing of the control valve.

U.S. Pat. No. 4,351,375—Polson, shows a valve for closing the vapor return passage, when the fuel is not being delivered. Polson provides a vacuum, automatic shut off system in a fashion similar to Walker, et al.

Yet another desirable, if not essential, feature for fuel nozzles is to provide means for minimizing, if not eliminating, damage to the nozzle or the hose or dispenser to which the hose is connected, in the event a vehicle is driven away from a dispensing unit with the nozzle lodged in the fill pipe of the vehicle's fuel tank. Regulatory authorities require this type of safety feature for most uses of fuel dispensing nozzles.

Such end is conventionally provided in single tube nozzles, by forming a groove in the tube to provide a weakened section and, thus, a predefined failure mode. This is to say that the tube fractures before there are forces sufficient to damage the nozzle body, connecting hose, or dispensing unit, or to topple the dispensing unit.

The provision of such capability in vacuum assisted vapor recovery nozzles, is made more difficult by reason of the fact that the spout is comprised of two tubes. Polson (4,351,375) does provide this breakaway capability for a dual tube spout, however, the means employed have the shortcoming of not being fully responsive to separation forces in bending. The result is that separation of the spout from the nozzle body may not occur as desired and forces will be transmitted to the hose and dispensing unit, which are sufficient to cause damage to those components. It will also be noted that the single tube spouts, are not fully responsive to bending forces, in obtaining a separation in the event of a driveaway.

Another shortcoming of prior art, vacuum assisted vapor recovery nozzles relates to obtaining a relatively high flow rate in the delivery of fuel. Overall spout diameter is limited by a restrictor plate, at a fill pipe inlet, which gives assurance that no-lead fuel will be used in the vehicle. The diameter of the inner fuel tube is thus limited by the need for it to be spaced radially inwardly from the outer tube to provide the spout, vapor return passage.

With these factors in mind, it can be appreciated that, for an automatic shut off, vacuum assist, vapor recovery nozzle, conventional approaches to providing a venturi venting passage, through the fuel passage spout, results in a restriction in fuel flow area and a consequent limitation on fuel flow rates. This factor is a function of the relatively small spout diameters of spouts for dispensing non-leaded fuels.

The general object of the present invention is to minimize, if not eliminate, shortcomings of vacuum assisted, vapor recovery nozzles, and particularly those shortcomings discussed above.

Another general object of the object of the present invention is to attain such ends in an economical fashion.

A more specific object of the present invention is provide a breakaway function for vacuum assisted, vapor recovery nozzles, which are more fully responsive to bending forces, in the event a vehicle is driven away with the nozzle spout lodged in the fill pipe of the vehicle's fuel tank, as well as providing such improved response to bending forces for other types of nozzle spouts.

Yet another object of the present invention is to provide a spout subassemblies which enable the foregoing ends to be attained.

In accordance with one aspect of the invention, the foregoing ends may be attained by a vapor recovery fuel nozzle comprising a nozzle body having an inlet end adapted for connection with dual passage hose means, one of which is a fuel passage and the other of which is a vapor return passage. A spout is mounted on a discharge end of the nozzle body and is adapted to be inserted into the fill pipe of a vehicle fuel tank. The spout and nozzle body compositely form a fuel passage for directing fuel from the inlet end to the outer end of the spout and into the fill pipe of the fuel tank.

The spout comprises an outer tube and an inner tube. The inner tube defines the spout portion of the fuel passage and the inner and outer tubes are radially spaced to define the spout portion of the vapor return passage. The distal ends of the spout tube are joined by a ferrule telescoped within the outer end portion of the outer tube. The ferrule preferably has a counterbore into which the outer end portion of the inner tube is telescoped. There is an interference fit between the telescoped portions of the ferrule and the outer tube and between the ferrule and the telescoped portions of the inner tube. This provides an economical means for joining the two tubes.

Advantageously, the outer and inner tubes and the ferrule are formed of stainless steel. It is also preferable to provide circumferentially spaced openings in the outer tube adjacent to and inwardly of the ferrule to provide an inlet to the vapor return passage.

Method aspects of the present invention are found in the steps of telescoping the inner and outer tubes and ferrule with interference fits therebetween in forming a novel spout subassembly.

Other ends of the invention are attained by a spout comprising inner and outer tubes, wherein at least the inner tube be formed of synthetic resin. The outer tube can be formed of synthetic resin, preferably a "structural" resin. Advantages are found in forming the inner tube of a flexible synthetic resin.

Other aspects to the invention are attained, in broad terms, by a spout comprising inner and outer tubes, in which the inner tube defines a fuel passage which is free of turbulence generators. The inner and outer tubes, in combination, define a vapor return passage. This spout further comprises a venting passageway employed in providing an automatic shut-off function and is characterized in that the venting passageway is disposed outwardly of the fuel passageway. Preferably the venting passageway is provided by a venting tube disposed in and extending longitudinally of the vapor return passage defined by the inner and outer tubes.

Nozzles in accordance with the present invention may also comprise a body member having a bore formed in its discharge end, and an adapter disposed in the bore. The adapter and body member define a fuel passage and a vapor return passage. Means for mounting the spout on the nozzle comprise a breakaway nut threaded onto the nozzle body member and sealingly connecting the outer spout tube to the adapter, with the spout vapor passage in communication with the adapter vapor passage and the inner tube in communication with the adapter fuel passage. The breakaway nut has a weakened section defining a failure mode, in the event a vehicle drives away with the nozzle connected thereto. Preferably, the fuel passage in the adapter comprises a central bore, the inner tube of the spout is slidably telescoped into the adapter bore, and the outer tube of the spout, at its inner end, has a radial flange, and the breakaway nut clamps the flange against the adapter. Additionally, it is preferred that the outer tube of the spout have a conical section connecting its outer portion with the radial flange.

The described feature of providing a radial mounting flange at the inner end of the outer tube, engaged by a breakaway nut, may also be generally employed in mounting dual tube spouts, and further can find utility in mounting single tube spouts.

Further aspects of the invention involve obtaining a desired orientation of a vacuum assist, vapor recovery spout relative to the body member of a nozzle. Such spouts comprise inner and outer tubes held in fixed angular orientation. In accordance with the present teachings, an adapter is mounted in a bore in the discharge end of the nozzle body in fixed angular relation thereto. The spout is mounted on the nozzle body, with the inner tube engaged with means angularly positioning the inner tube relative to the nozzle body.

A useful feature of the invention is found in the use of notches, at the end of the inner tube, which are engageable with lugs in the adapter bore, to obtain the desired angular orientation. The inner tube is then sealed relative to the adapter by an O-ring which is received in a counterbore. A backup ring on the inner spout tube positions the O-ring in the counterbore.

Other aspects of the invention are attained by a nozzle which comprises a body member having a bore which receives an adapter. A dual tube spout mounted on the nozzle body. The inner, spout tube, forms a continuation of a fuel passage extending from the inlet end of the nozzle body and through the adapter. A poppet type vapor valve is disposed beneath the adapter. Vapor return passageway means extend from the distal end of the spout, to passageway means, defined by the body member and the adapter, to the vapor valve. The vapor return passageway means extend from the vapor valve through passageway means, defined by the body member and the adapter, to passageway means which extend through a hand grip portion of the nozzle body. This nozzle further comprises a vacuum system for automatically terminating fuel flow, when the level of fuel in a fill pipe reaches the nozzle spout inserted therein. This nozzle is characterized in that the vacuum system is sealed from the vapor return passageway means.

In addition to the foregoing, and pursuant to further objects thereof, the present invention also provides a vapor recovery fuel nozzle comprising an improved compositely formed nozzle body which includes a nozzle body member and a vapor cap.

A fuel passage is defined by the nozzle body member and a vapor return passage is compositely defined by the nozzle body member and the vapor cap. A main valve for controlling flow of fuel through the body member includes upwardly projecting housing means. A trip mechanism for controlling operation of the main valve, includes upwardly projecting housing means. The vapor cap extends upwardly and over trip mechanism housing means, over the valve housing means and then downwardly to a hand grip portion.

This composite nozzle body is characterized in that one of the housing means, preferably the trip mechanism housing, has wing means disposed between the vapor cap and the nozzle body These wing means are generally aligned with adjacent surfaces of the nozzle body member and the vapor cap, so that the exterior surfaces of the nozzle body are compositely formed by the vapor cap, body member and wing means.

The present invention, pursuant to a further object thereof, also addresses and provides a solution to the problems posed by the relatively large diameters of coaxial hoses as well as the relatively high stiffness of such hoses. More specifically, vapor recovery nozzles can be and are formed with a hand grip portion of a comfortably small diameter, while providing both fuel and vapor return passages therethrough. The problem is that the larger diameter of coaxial requires the inlet end of the nozzle body to be enlarged for connection of the coaxial hose thereto. Such enlargement interferes with manipulation of the nozzle in disposing the nozzle in a vehicle fill pipe, or gives a user the impression that it is cumbersome to do so.

This problem is overcome by providing a fitting for connecting a hose, or swivel, to the inlet end of the nozzle body, with the fitting angled downwardly, preferably on an angle of 20°. The enlargement for effecting a connection with a coaxial hose (or swivel) may thus be disposed beneath the level of the hand grip. This angulation has the further advantage of facilitating the relatively stiff coaxial hose to drape downwardly and make manipulation of the hose easier, when the nozzle is being inserted into and removed from the fill pipe.

The present invention also addresses the problem of vapor escaping into the atmosphere in the event the capacity of the vacuum pump, in a vacuum assisted system, is insufficient to create an "air seal" within the fill pipe, as contemplated in the above identified Lasater patent.

As previously noted, one of the advantages of a vacuum assisted vapor return system is the elimination of cumbersome sealing shrouds, also known as bellows, for providing a seal with the inlet to a vehicle fill pipe. Such sealing shrouds are required because of the positive pressure in the vapor return passage. In contrast, the Lasater patent teaches the provision of a vacuum in the vapor return passage which draws sufficient air into to fill pipe to create an "air seal" between the spout and the interior of the fill pipe. If the capacity of the vacuum pump is insufficient to create such a seal, then there is a possibility of vestigial amounts of vapor escaping from the fill pipe and into the atmosphere.

The solution provided is a vestigial shroud disposed at the inner end of a spout, which comprises an inner fuel tube and an outer tube, which defines, in combination with the inner tube, a vacuum, vapor return passage. The vestigial shroud engages the outer end of the fill pipe during delivery of fuel to create an "air seal" therebetween and thereby prevent escape of vapor into the atmosphere.

The vestigial shroud is relatively short, preferably having a length less than about one third of the length of the spout. The discharge end of the spout thus remains visible to the user to facilitate its insertion into a fill pipe.

Vestigial shrouds of the present invention are distinguished from sealing shrouds of balance vapor recovery systems in that they are not intended to create a mechanical, or positive seal with the fill pipe. Instead, a vestigial shroud functions to reduce the cross section available for entry of air, from the atmosphere, into the fill pipe. By so reducing the area for air entry, the air velocity, for a given negative pressure in the vapor return passage, increases to create an "air seal". The air seal is thus created between the outer end of the fill pipe and the shroud, instead of being between the spout and the interior of the fill pipe.

As indicated, the vestigial shroud is not intended to create a mechanical, or positive seal with the fill pipe. Since the vapor return path is connected to a vacuum pump, a mechanical seal with the vestigial shroud could result on negative pressures sufficient to cause damage. In order to limit negative pressure build up, the shroud surface which engages the fill pipe of an uneven nature. Further, a check valve may be provided in the vestigial shroud. The check valve opens, to permit the admission of atmospheric air in the event that there is positive sealing engagement between the vestigial shroud and the fill pipe.

In contrast to a sealing shroud, a vestigial shroud does not require the exertion of a high force on the nozzle to obtaining the desired air seal. The fact that at least some negative pressure is generated in the fill pipe tends to draw the vestigial shroud into close proximity with the fill pipe to obtain the desired "air seal".

The above and other related objects and features of the invention will be apparent from a reading of the following description of preferred embodiments, with reference to the accompanying drawings, and the novelty thereof pointed out in the appended claims.

In the drawings:

FIG. 9 is a section taken generally on line 9—9 in FIG. 6;

Figures 1, 1A:
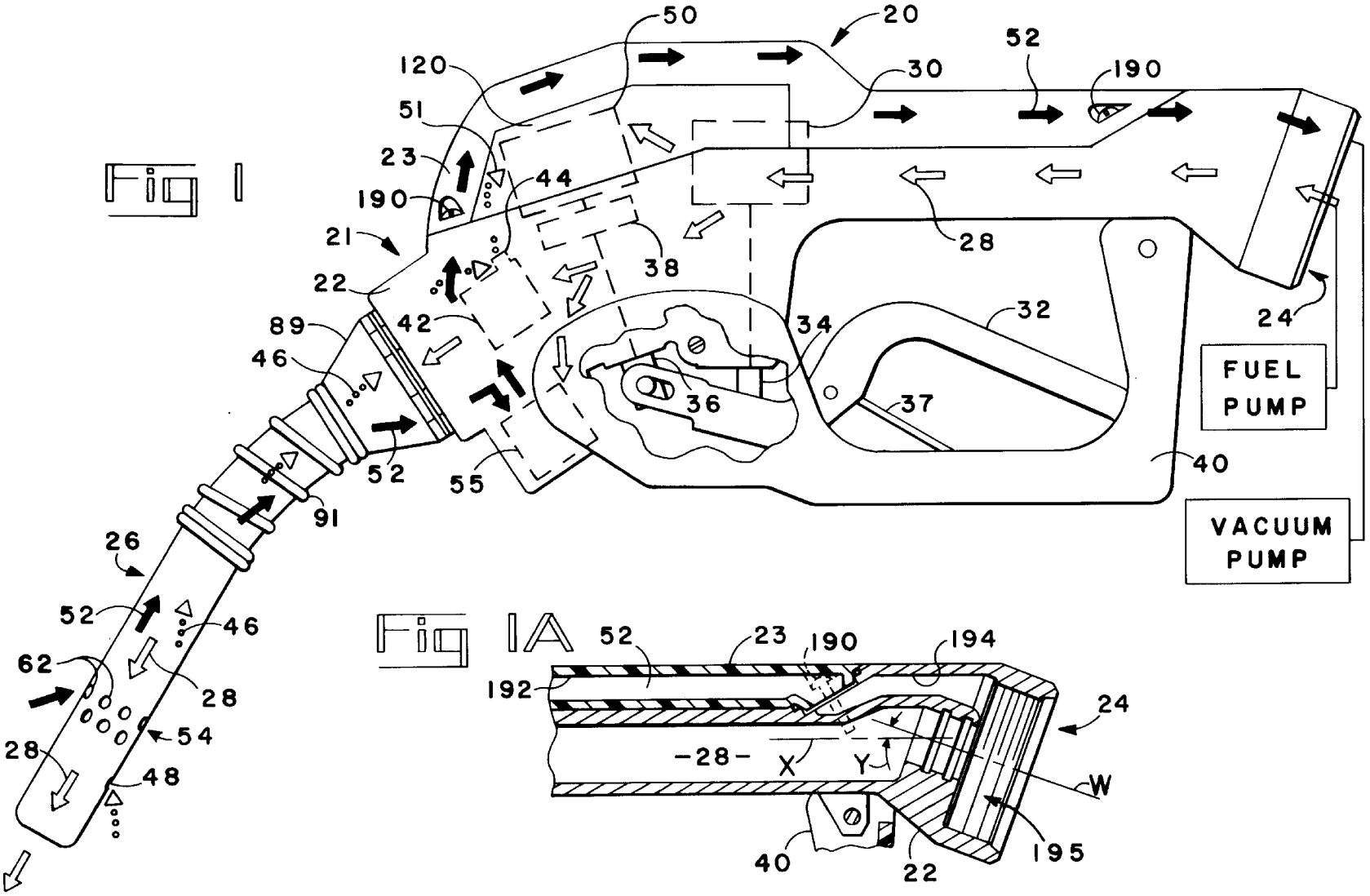
FIG. 1 is an elevation, with portions broken away, of a vacuum assisted, vapor recovery fuel nozzle, embodying the present invention.
FIG. 1A is a longitudinal section of the inlet end portion of the nozzle, illustrating a fitting for connection to a coaxial fuel hose.

Reference is first made to FIG. 1 for a general description of the functions provided by the present nozzle, which is generally identified by reference character 20.

It will first be noted that the nozzle 20 is intended for use in vacuum assisted vapor recovery systems, wherein vapors displaced from a vehicle fuel tank, by the discharge of fuel therein, are captured and returned to a remote location, in order to minimize, if not eliminate, such vapors from becoming a source of air pollution. Such systems comprise a dual passage hose connecting the nozzle to a stationary dispensing unit. One hose passage is connected to a source of pressurized fuel (fuel pump). The other hose passage is connected to return conduit means extending to the remote location, where they may be condensed and returned to the fuel storage tank. A vacuum pump, or other means, is provided for maintaining the return conduit means at a negative pressure.

The nozzle 20 comprises a composite nozzle body 21 formed by a nozzle body member 22 and a vapor cap 23. The nozzle body 21 has an inlet end 24, which is adapted for connection with a coaxial dual passage hose to provide communication with the fuel and vacuum sources, as above referenced.

A spout 26 is connected to and projects from the outlet end of the nozzle body 21, and more specifically from the body member 22. A fuel passage 28 (indicated in FIG. 1 by hollow arrows) is defined by the nozzle body member 22 and spout 26 to provide for the flow of fuel through the nozzle and enable its discharge into the fuel tank of a vehicle, or other container. A normally closed, fuel valve 30 is mounted in the nozzle body member 22 and is opened by manually raising a lever 32 to lift a valve operating stem 34.

The valve 30 may take any of many well known valve constructions. Preferably it is of a vertically disposed poppet type, as later described. The lever 32 is pivotally mounted on a trip stem 36, the function of which is later discussed. A latching mechanism 38 is provided to maintain the trip stem 36 in an elevated position and thus enable the valve 30 to be held in an open position. Further, a lever guard 40 is mounted on the body member 22. These elements of the nozzle 20 may also take various forms, as are presently employed in the art.

The present nozzle provides an automatic shut off feature for preventing overfilling of a fuel tank. To this end, a venturi valve 42 is disposed in the fuel flow path 28, adjacent the discharge end of the nozzle body member 22. As fuel flows through the venturi valve, a vacuum is generated within a chamber, or passage, indicated at 44, in the body member 22. A venting passage 46 (illustrated by dotted arrows in FIG. 1) extends from an entrance 48, adjacent to the outer end of the spout 26, through the spout and then to the vacuum chamber 44.

In normal delivery of fuel into a fuel tank, the spout 26 is inserted into the tank's fill pipe to discharge fuel therefrom. The vacuum generated in the chamber 44, by the venturi valve 42, is minimal as air is drawn through the venting passage 46. When the level of fuel rises to the level of the vent passage entrance 48, a substantial negative pressure (vacuum) is generated in the chamber 44. This increase in negative pressure is then effective to cause the valve 30 to close. Such end is attained by the venturi chamber 44 being [is] connected to a trip mechanism 50 by a vacuum passage 51 (also indicated by a dotted arrow in FIG. 1). When the venting passage entrance (48) is blocked, the increased negative pressure is communicated to the trip mechanism 50 and actuates the latch mechanism 38, causes the stem 36 to be released from its elevated position. When this occurs, the lever can no longer maintain the valve 30 in its open position, whereby, flow of fuel is automatically interrupted to prevent overfilling of the fuel tank and spilling of fuel onto the ground.

While further reference will be made to components thereof, the operative principles of the automatic shut off function, as described to this point, are well known and the trip and latching mechanism can take various forms.

The nozzle 20 also comprises a vapor return flow passage 52 (indicated by solid arrows in FIG. 1), which extends from an inlet 54 at the outer end portion of the spout 26 to the inlet end 24. The vapor return passage 52 is connected, at the nozzle inlet end 24 to the other passage of the dual passage hose, previously referenced. That passage communicates with the vacuum source (vacuum pump), to thereby maintain a negative pressure in the vapor return passage 52. When the spout 26 is inserted into a vehicle tank fill pipe, the vapor return entrance 54 is disposed within the confines of the fill pipe, inwardly of the outer end of the fill pipe. Preferably, the capacity of the vacuum pump is sufficient to create an "air seal" and draw substantially all fuel vapors, displaced from the fuel tank during a filling operation, into the vapor return passage 52, thereby minimizing, if not preventing their pollution of the atmosphere (reference U.S. Pat. No. 4,199,012—Lasater).

A vapor valve 55 is provided in the vapor return passage 52. The vapor valve, during delivery of fuel, is opened in response to opening of the fuel control valve 30. Note the open arrows indicating a fuel pressure input to the vapor valve 55. This pressure input is derived intermediate the main valve 30 and the venturi valve 42. The valve 55 is automatically closed, when the main control valve is closed. By closing the valve 55 when the nozzle 20 is not in use, it is possible to deenergize the vacuum pump, without permitting vapors in the vapor return system to escape into the atmosphere. Additionally, closing of the valve 55 reduces the load on the vacuum pump, where the pump provides a vacuum source for a plurality of dispensing units and/or nozzles.

The spout 26, as will be apparent from the foregoing, provides portions of the fuel passage 28, the venturi venting passage 46 and the vapor return passage 52. It is, preferably, formed as a sub-assembly, as illustrated in FIGS. 2–5. This subassembly comprises an inner tube 56, which is telescoped into and sealingly engaged with a counter bore formed in a ferrule 58. The ferrule 58 is, in turn, telescoped within an outer tube 60. Preferably, the outer end of the tube 60 has an inwardly curved lip, which functions to position the ferrule 58 longitudinally of the outer tube 60 at its distal end. The outer end, or distal, of the inner tube 56 is longitudinally positioned by engagement with the bottom of [the] a counter bore 61 in the ferrule 58. In this fashion, an accurate relationship between the inner ends of the tubes 56, 60 is obtained.

The inner tube 56 and the ferrule 58, in combination, define the fuel flow path 28 through the spout 26. The tubes 56, 60 combine to define the vapor return flow passage 52 through the spout 26. This portion of the return flow passage has a concentric, annular cross section, though concentricity of the tubes 56, 60 is not of great importance. The inlet 54, to the vapor return passage 52 is provided by a plurality of openings 62, formed in the tube 60 adjacent to and inwardly of the ferrule 58.

It is to be noted that, in use, fuel nozzles are subject to considerable physical abuse. This is particularly true with respect to the terminal end portion of the spout. The described construction minimizes the affects of such abuse through the provision of the ferrule 58 between the inner and outer end portions of the tubes 56, 60. These end portions are thus reenforced to the end that they will not be deformed in normal use. Within the context of the present invention, the ferrule 58 and the terminal end portions of the tubes 56 and 60, secured thereto, are deemed to be means for joining the tubes 56 and 60, with the joining means having a diameter approximating that of the outer tube 60 and an inner diameter approximating that of the inner diameter of the inner tube 56.

The major portion of the venting passage 46, which extends through the spout 26, is formed by a tube 64, disposed within the annular vapor return passage 52, as defined by the tubes 56, 60. The outer end of the tube 64 is received in a slot 66 (FIG. 5), formed in the bottom wall portion of the ferrule 58. The outer end of tube 64 is spaced from the inner end of this slot. The inner end of the slot 66 is registered with a hole 68, formed in the outer tube 60, to define the inlet 48 for the vent passage 46.

The venting passage tube 64 is coiled, within the annular vapor return passage of the spout, from a 6 o'clock position, at the ferrule 58 to a 9 o'clock position, at the inlet end of the inner tube 56 (when looking at the spout from its outer end). The inner end of the outer tube 60 has a conical section 70, which terminates in an outwardly projecting radical flange 72. The inner end of the vent tube 64 is then bent outwardly, at a low angle, from the inlet end of the inner tube 56, to facilitate its mounting on the nozzle (reference FIG. 7).

In accordance with method aspects of the invention, the spout sub-assembly 26 is fabricated by forming the tube 56 from a section of straight tubing, having a given length, forming the tube 60 with a straight section of a given length, including the curved outer end and conical section 70 and flange 72, at the inner end. Additionally, the openings 62, 68 are formed in this straight length of tubing. The ferrule 58 is formed with the counterbore 61 of a given depth. The diameter of the outer end of the tube 56 and the diameter of the counterbore 61 are formed to provide an interference fit therebetween. The outer diameter of the ferrule 58 and the inner diameter of the tube 60, at least at its outer end, are also formed to provide an interference fit therebetween. The ferrule 58 also has the slot 66, with a given depth formed therein.

The venting tube is formed with a given length and bent to a configuration in which its outer end is at a 6 o'clock position and its inner end is at a 9 o'clock position, with the tube generally spiraled about a diameter approximating that of the inner tube 56. The inner end of the vent tube 64 may also be bent outwardly to a relatively low angle.

Using appropriate mandrels, the outer end of the inner tube 56 is inserted into the counter bore of the ferrule 58 and the outer end of the vent tube 64 may then be inserted laterally into the slot 66, with the inner end of the vent tube 64 disposed in a 9 o'clock position. The tube 64 has an interference fit with the side walls of the slot 66 and is relatively weak so that it may be conformed to a generally square shape, within the slot 66, when so assembled on the ferrule 58. An appropriate die may be employed to conform the tube 64 to the outer diameter of the ferrule 58, to facilitate its subsequent assembly with the outer tube 60. From FIG. 5, it will be seen that a ledge may be provided outwardly of the inner end of the slot 66, to axially position the tube 64 in the slot.

The ferrule 58, with the inner tube 56 and vent tube 64 attached by the referenced interference fits, may then be telescoped into the outer tube 60. Opposing forces on the free [outer] end of the tube 56 and the outer end of the tube 60 are then employed to telescope the ferrule 58 into engagement with the inwardly curved, outer end of the tube 60, namely the relationship seen in FIG. 2.

By reason of the referenced interference fits, there is a swaging, or metal displacement, as the components are telescoped and displaced to their assembled relation. This results in a strain of the ferrule and the tubes 56, 60 and 64, which mate therewith. These components have a sufficient resilient property that the strain creates a stress force holding them in assembled relation. Stainless steel is a suitable material for the spout components in that it has a sufficiently high yield strength, resists corrosion and is not subject to chemical attack by petroleum based fuels.

The interference fits between the assembled components also provide sealed connections therebetween without the need of employing separate sealing means, such of O-rings, or soldered connections. In this regard, it is again noted that the circular cross section of the tube 64, is deformed to a substantially rectangular cross section, within the slot 66, between the tubes 56, 60.

Figures 2, 2A, 3, 4:
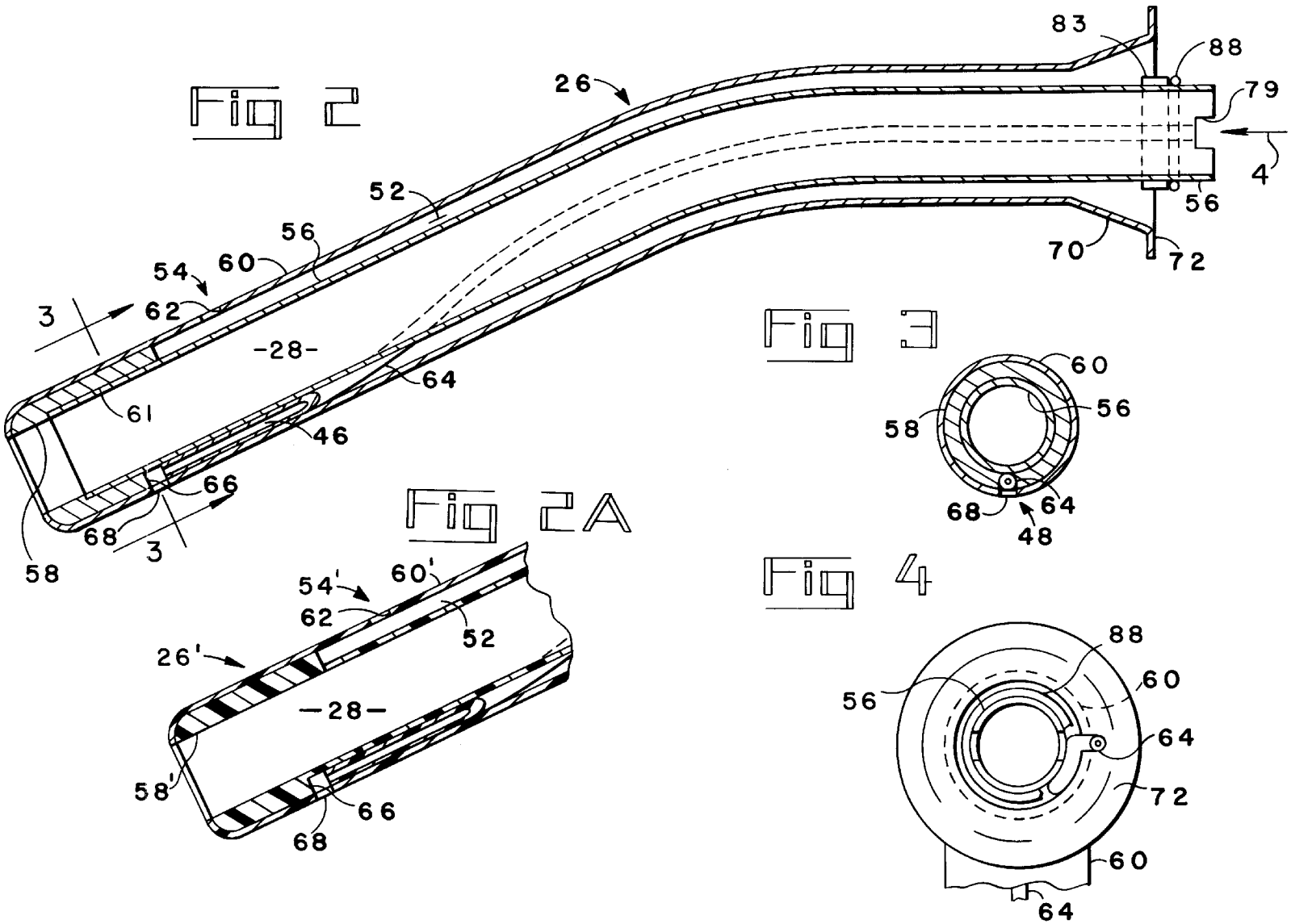
FIG. 2 is a longitudinal section of the spout sub-assembly employed in the present nozzle.
FIG. 2A is a longitudinal section of the outer end portion of an alternate construction of spout sub-assembly.
FIG. 3 is a section taken on line 3—3 in FIG. 2.
FIG. 4 is an end view of the spout seen in FIG. 2, taken in the direction of arrow 4.
Figure 5:
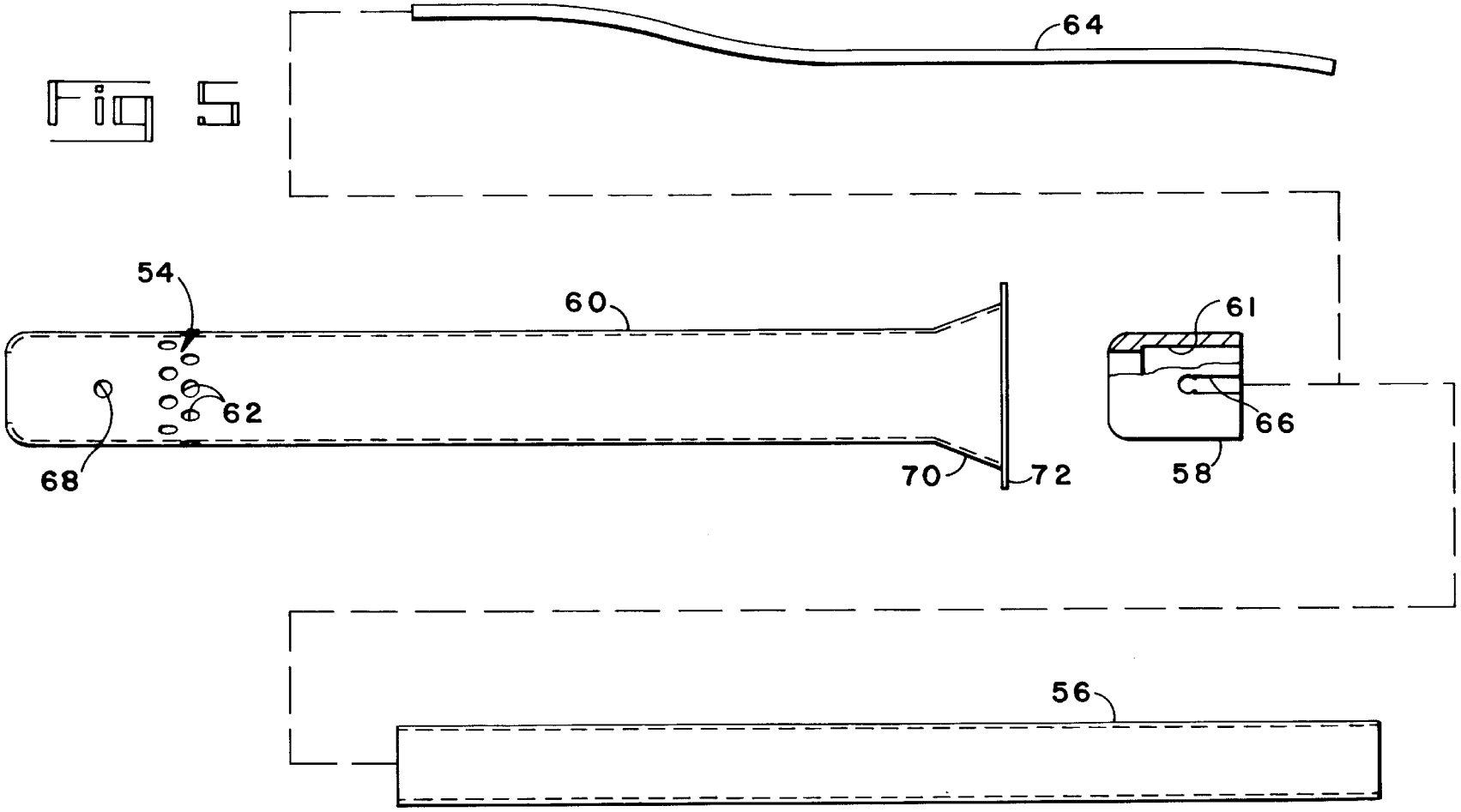
FIG. 5 is an exploded view of the components of the spout sub-assembly, illustrating its method of manufacture.

After the ferrule 58 and straight tubes 56, 60 are thus assembled, they are bent to the curved configuration of FIG. 2 through the use of appropriate mandrel means.

A further advantage of the described method of assembly is that it does not require elevated temperatures, or the use of bonding agents which could include potentially hazardous chemicals.

The described spout construction and subassembly may also be advantageously formed employing synthetic resin components, commonly referenced as plastics. FIG. 2A illustrates an alternate spout construction employing "plastic" components, which are identified by like reference characters, which have a "prime" designation.

The outer tube 60 may be of a "structural" type resin. There are many "structural" type resins that could be employed for such purpose, delrin being an example. The ferrule 58, inner tube 56 and vent tube 64 may also be formed of "structural" resins.

In general, "structural" resins have a relatively low resilience, that is, they take a permanent set, after they have been strained to a relatively limited extent. Because of the widely varying temperatures to which fuel nozzles are subject, and the resultant thermal expansion and contraction, there is a tendency for the effectiveness of interference fits to be lost over a period of time. Thus, when employing "structural" resins, it is preferred to employ an independent bonding mechanism, such as a glue, solvent or thermal fusion, to hold the spout components in assembled relation.

The inner tube 56 could also be formed of a flexible type resin, or rubber, which is essentially rigid when subject to axial compression despite being laterally flexible, i.e., bendable. By so doing, fabrication and assembly of the spout may be further simplified. This is to say that the tube 60, could be molded, of a "structural" resin in the final, curved configuration illustrated in FIG. 2. With the inner tube 56 formed of a flexible material and attached to a ferrule 58, which may also be formed of a synthetic resin, the inner tube can be inserted into the curved outer tube and then bonded, by adhesive or the like, to complete the sub-assembly. As will later appear, when the spout sub-assembly is mounted on the nozzle body member 22, the inner tube 56 is sealingly telescoped into a bore, which defines an upstream portion of the fuel passage 28. The flexibility of the resin tube 56 and its axial rigidity enable such assembly.

The vent tube 64 may also be formed of a flexible, axially rigid resin. The same properties which facilitate connection of the flexible, axial rigid inner tube 56, to the nozzle portion of the fuel passage 28, also facilitate connection of the flexible, axially rigid vent tube 64 to the portion of the venting passage 46 within the nozzle body member 22.

Where resins are used for the tubes 56 or 60, it is preferred that the resin be electrically conductive. Electrically conductive resins, suitable for the present purposes are well known and commercially available.

The use of resinous materials can also enable elimination of the ferrule 58 as a separate element, as is illustrated in FIG. 2A. This is to say that the reenforcement function provided by the ferrule 50 can be economically attained by forming the ferrule as an integral part of the outer tube 60 or as an integral part of the inner tube 56. The latter alternate construction is illustrated in FIG. 2A. The tubes 56, 60 and 64 are sectioned to indicate that they are formed of plastic materials. The ferrule 58 is not a separate element, but, instead is integrally molded with the inner tube 56.

Reference will next be made to FIGS. 6–9 for a description of the means employed in mounting the spout 26 on the nozzle body 21.

The outlet end of the nozzle body member 22 has a stepped bore 74 which receives an adapter 76. The inner, upstream end of the adapter 76 has an O-ring sealing connection 78 with the reduced, inner diameter of the bore 74. An outer adapter flange 80 is received in the outer end of the bore 74. One or more adapter mounting screws 82 extend through the nozzle body member 22 and are threaded into the adapter flange 80 to secure the adapter 76 on the nozzle body member 22 in a fixed angular relation thereto.

The inlet end of the central, fuel passage tube 56 is telescoped into a central bore 86 in the adapter 76, with a sealed connection therebetween being provided by an O-ring 88. The bore 86, in part, defines the fuel flow passage 28, through the adapter 76.

Figure 6:
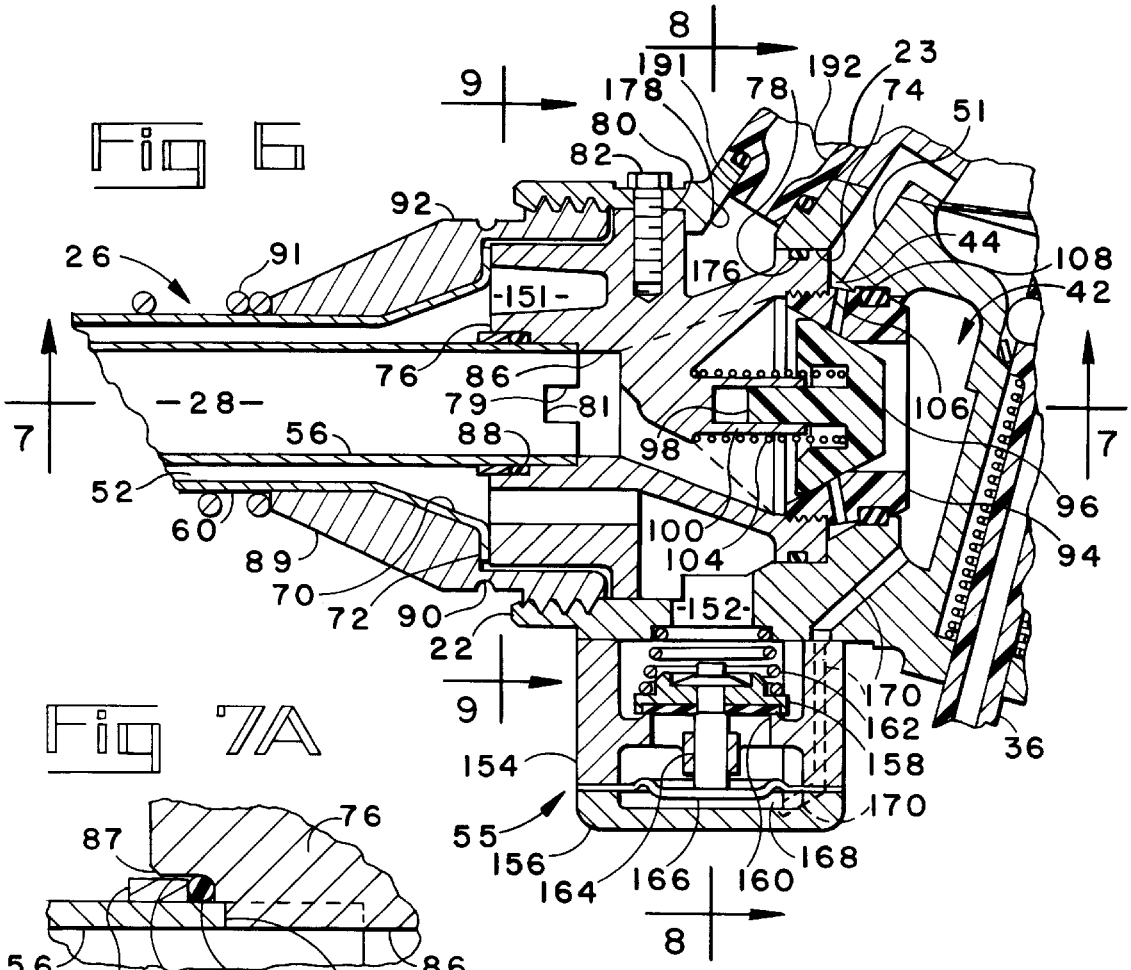
FIG. 6 is a longitudinal section illustrating the connection between the nozzle spout and nozzle body and the flow passages associated therewith.
Figure 7A:
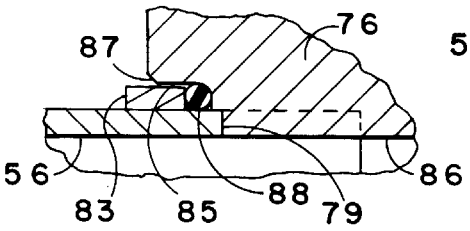
FIG. 7A is a fragmentary, enlarged view of a portion of FIG. 7, illustrating a sealed connection of the inner tube of the nozzle spout.
Figure 7:
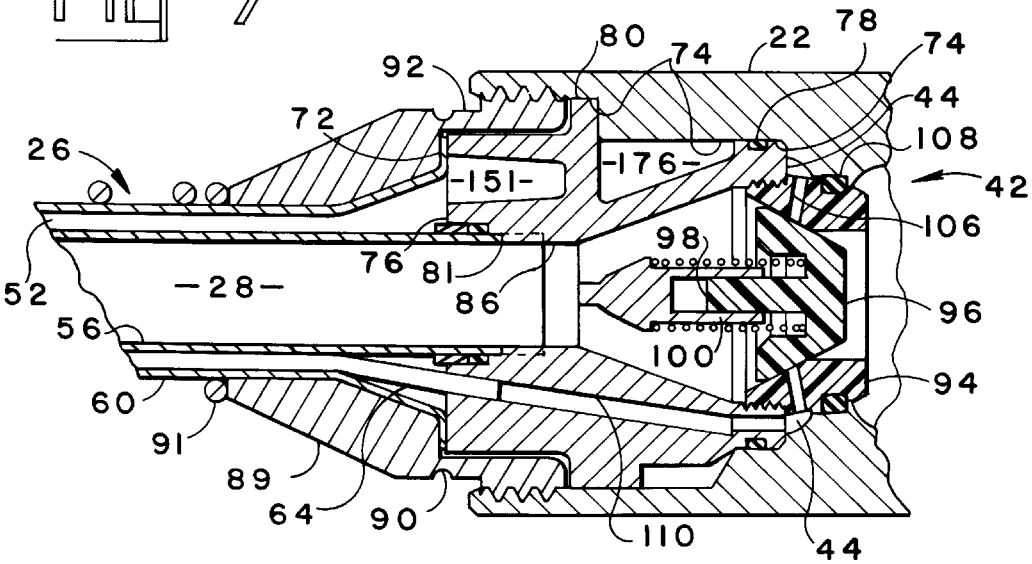
FIG. 7 is a section taken on line 7—7 in FIG. 6.
Figure 7:
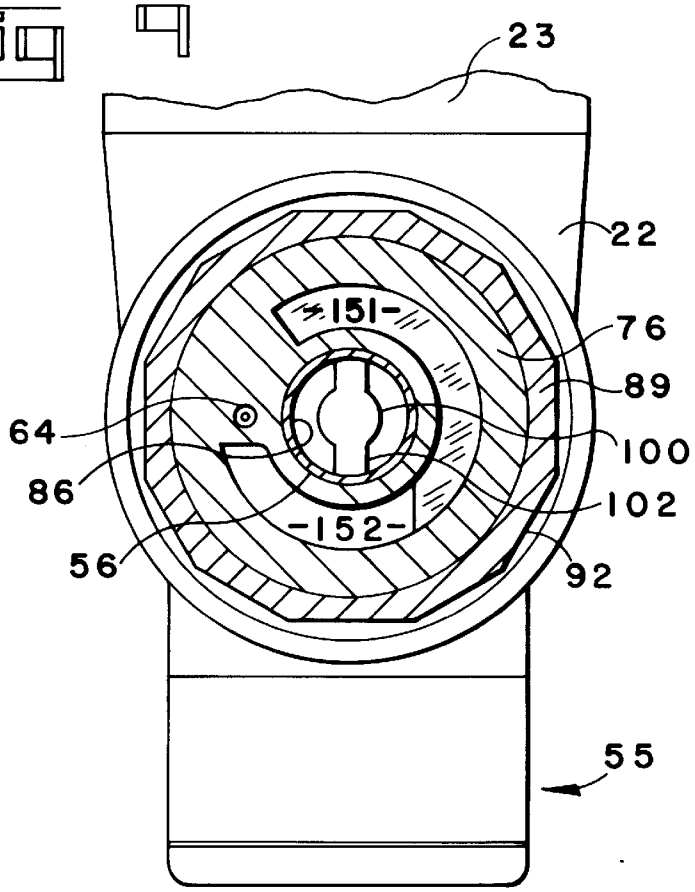
Figure 8:
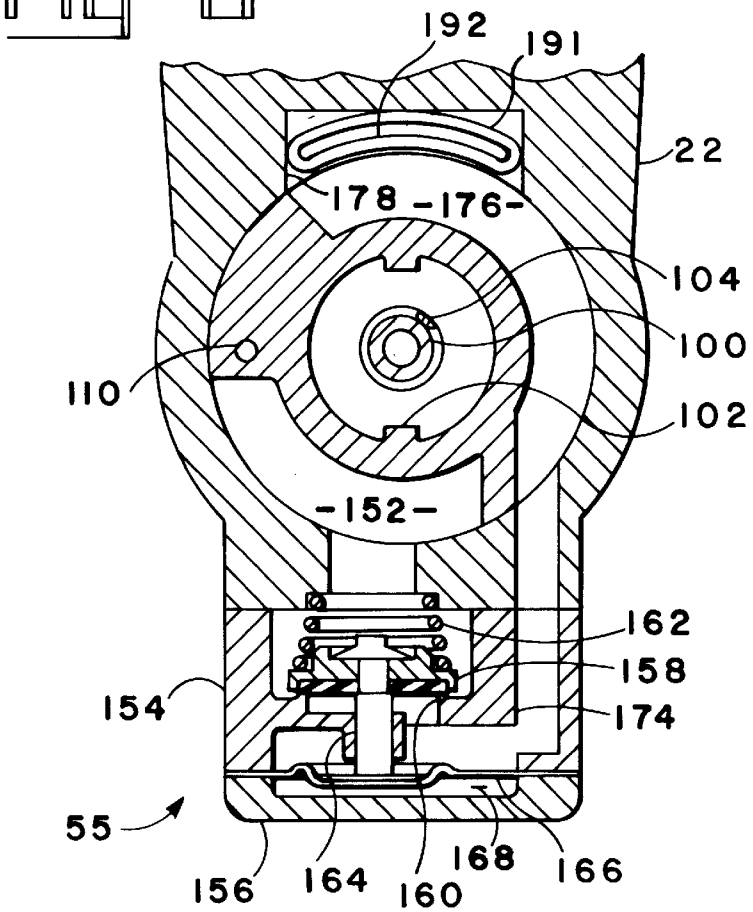
FIG. 8 is a section taken generally on line 8—8 in FIG. 6.

A preferred feature is found in effecting a sealed connection between the inner tube 56 and the adapter 76. The adapter is in a fixed angular position relative to the nozzle body member 22 by reason of the mounting screws 82. The inner tube 56 is angularly positioned relative to the adapter 76 by notches 79 which are received by lugs 81 on the adapter bore 86 (FIGS. 6, 7). This has been found to be an efficient and effective manner of assuring a correct alignment of the dual tube spout, i.e, positioning the spout so that its [outer] discharge end portion will be properly angled in a downward direction.

Reference is made to FIG. 2 and a backup ring 83 which is included in the spout assembly, by welding or otherwise securing the back up ring 83 to the inner tube 56, inwardly of the notch 79. Prior to mounting the spout on the nozzle body 22, the O-ring 88 is telescoped over the tube 56 to a position inwardly of the notch 79. The spout assembly is then mounted by first inserting the tube 56 into the bore 86. It is to be noted that the outer end of the bore 86 is counterbored, at 85, to a diameter sufficient for the O-ring 88 to be compressed and provide a seal therebetween. It will also be noted the outer end of the counterbore 85 is countersunk at 87. Thus, when the tube 56 is inserted, into the bore 86, the back up ring 83 forces the O-ring 88 into the counterbore 85, with initial compression of the O-ring 88 being facilitated by the countersink 87. All of this gives a high level of assurance that the O-ring 88 will not be damaged during assembly.

A breakaway nut 89 is then threaded into the nozzle body member 22 to clamp the spout flange 72 peripherally of the outer face of the adapter 76, as well as clamping the inner end of the adapter against the inner end of the bore 74. It is to be appreciated that a gasket could be provided between the flange 72 and adapter 76 in order to assure a seal therebetween. The breakaway nut 89, preferably has a tapered bore which approximates the taper of the conical tube section 70. These tapered portions minimize stress concentrations at the connection between the outer tube and the nozzle body. The outer end portion of the breakaway nut 89 has a corresponding taper, for purposes of minimizing weight and eliminating potentially hazardous, sharp projections. An anchor spring 91 may be telescoped over the outer spout tube 60.

The breakaway nut 89 provides a predefined failure mode in the event a vehicle drives away from a dispensing unit, with the nozzle spout lodged in the fill pipe of the vehicle's fuel tank. To this end, a circumferential groove 90 is formed in the breakaway nut 89 to provide a weakened section that will fracture when there is a predetermined load on the spout, such load being of a magnitude encountered when a driveaway occurs. The breakaway nut 89 is preferably formed of an acetal resin, or other synthetic resin material having a well defined ultimate strength.

When the nut 89 fractures, the spout 26 is free to separate from the nozzle body, specifically from the adapter 76. The nozzle body member 22 is thus protected from damage and may simply be put back into service by using a new breakaway nut to reattach a spout thereto. While it would be possible to use the old spout, if it is undamaged, the preferred practice is to employ a new spout. In any event, the costs of putting a nozzle back in service, after a driveaway occurs is minimized.

The provision of such a predetermined failure mode is well known in single tube nozzles, usually taking the form of a groove in the spout tube, rather than in the mounting means therefor. The described structure provides the breakaway function for a vapor assisted vapor recovery nozzle, which is characterized by inner and outer tubes, which are in fixed axial relation. This is to point out that the outer tube (60) is clamped to the nozzle body (21), while the inner tube is free to be axially pulled from the nozzle body (21).

It is to be noted that, when a vehicle driveaway occurs, the separation forces, exerted on the spout 26 may be in bending as well as in tension. The described, breakaway mounting, wherein the breakaway forces are transmitted through the radial flange 72 is particularly effective in assuring that a fracture of the nut 89 will occur in response to bending separation forces, as well as tension separation forces. This is to point out that prior breakaway mountings have not been fully responsive to bending separation forces. By clamping the outer tube through the flange 72, the leverage of a bending force on the spout is increased and the magnitude of the bending force required for separation becomes less critical. Thus, there is a greater assurance that separation will occur before there is damage to the nozzle body, or transmission of forces sufficient to damage the hose or the dispensing unit.

In further connection with the fact that there are bending forces, it is to be noted that the tube 56 is, preferably inserted into the bore 86 a relatively short distance, one tube diameter or less to minimize the possibility of the tube cocking in the bore. It is also to be recognized that the above described use of a flexible resin to form the tube 56 minimizes the possibility of the fuel tube cocking in the bore 80 and thus assures a clean separation of the spout when a driveaway occurs.

It is to be noted that the breakaway nut 89 is threadably connected to the nozzle body member 22, so that when it fractures, the stress of the fracture forces are transmitted into the nozzle body member 22 and isolated from the adapter 76. It is preferred, as illustrated, that this threaded connection comprise male threads on the nut 89 and female threads on the body 22.

It will also be noted that the nut 89 is provided with a torquing portion 92 (polygonal cross section seen in FIG. 9) outwardly of its threaded portion and that the groove 90 is intermediate the length of the torquing section. Thus, after the nut 89 has been fractured, by a driveaway, the portion of the nut 89, which remains with the nozzle body, may be readily removed, by reason of the remaining portion of the torquing portion. Remounting of a spout 26 on the nozzle body is thereby facilitated in that, normally, none of the nozzle body components, and the adapter 76, in particular, are involved in the process of putting the nozzle back into service.

The description of the fuel passage 28 will next be further pursued, with continued reference to FIGS. 6–9.

As previously referenced, the venturi valve 42 is disposed in the fuel passage 28, adjacent the outlet end of the nozzle body. More specifically, the venturi valve is mounted on the upstream end of the adapter 76. The venturi valve 42 comprises a seat member 94 and a poppet 96. The poppet 96 has a stem 98, which is slidably received in a tubular portion 100, of the adapter 76. The fuel passage 28, upstream of the bore 86 expands to the seat member 94 and the tubular portion 100 is positioned by radial fins 102, which are disposed in this expanded portion. A spring 104 yieldingly maintains the venturi poppet 96 closed against the seat member 94.

When the main valve 30 is opened, the poppet 96 is opened by fuel pressure and the fuel flows through a throat, defined by the poppet 96 and seat 94, at an accelerated rated. The throat is connected by one or more radial passages 106, formed in the seat member 94, to the previously referenced vacuum chamber 44. Chamber 44 is formed annularly in the nozzle body member 22 and is sealed from other flow passages in the nozzle by the O-ring 78 on its downstream side and by an O-ring 108, in the valve seat 94, on its upstream side. Flow of fuel through the venturi valve 42 thus creates a negative pressure in the chamber 44.

The inner end of vent tube 64 is inserted in a passage 110 (FIG. 10), which extends through the adapter 76 and opens into the vacuum chamber 44. Thus, so long as the entrance 48, to the venting passage 46 is open, air is free to be drawn into the chamber 44 and the negative pressure generated therein, will be minimal.

It is to be appreciated that the described spout 26 provides further a advantage in that the fuel flow passage therethrough (i.e., the inner diameter of the tube 56 and the bore of ferrule 58) are free of any turbulence generators. This is to say that this portion of fuel passage way is circular in cross section and provides a minimum resistance to fuel flow, by reason of the vent passage, i.e., the vent tube 64, being disposed outside the fuel flow passage, within the annular vapor return passage 52.

It will be appreciated that, in the event of a driveaway (see above discussion), the tube 64 is free to be pulled from the adapter 76.

The vacuum chamber 44 also communicates with the trip mechanism 50 by way of the vent passage 51, which is compositely formed in the nozzle body member 22 and in the trip mechanism.

In brief, the trip mechanism 50 (FIGS. 10 and 11), controls the latch mechanism 38 to the end that the trip stem 36 is maintained in an elevated position or is free to move downwardly. When the trip stem 36 is maintained in its elevated position, i.e., latched, the lever 32 (FIG. 1) is effective to open the main valve 30. When the trip stem 36 is free to move downwardly, i.e., unlatched, the lever 32 is ineffective to open, or maintain open, the main valve 30 and flow of fuel is interrupted or prevented.

The trip mechanism is responsive to the negative pressure in the chamber 44 as a result of the entrance to the venting passage being blocked by fuel in a fill pipe, as fuel is being delivered. Such blockage results in an increase in the negative pressure input to the trip mechanism.

The trip mechanism 50 is also effective to release the latch mechanism when there is a loss of or no pressurization of fuel being delivered to the nozzle. This latter feature is optional and enables the use of the nozzle in so-called pre-pay fuel dispensing systems. In such pre-pay systems, means are provided for programming the pre-paid amount into a control system, which energizes a pump to pressurize the fuel hose connection to the nozzle. When the pre-paid amount has been delivered, the pump is deenergized. In order to accurately control the amount of fuel delivered, the [diaphragm] trip mechanism is also actuated to release the latch mechanism and automatically close the main valve 30. To effect these ends, the trip mechanism 50 is also responsive to fuel pressure in the fuel passage 28, upstream of the valve 30. More specifically, there must by a positive fuel pressure input to the trip mechanism 50 for the latching mechanism 38 to be effective in maintaining the trip stem 36 in an elevated, operative position.

Figure 10:
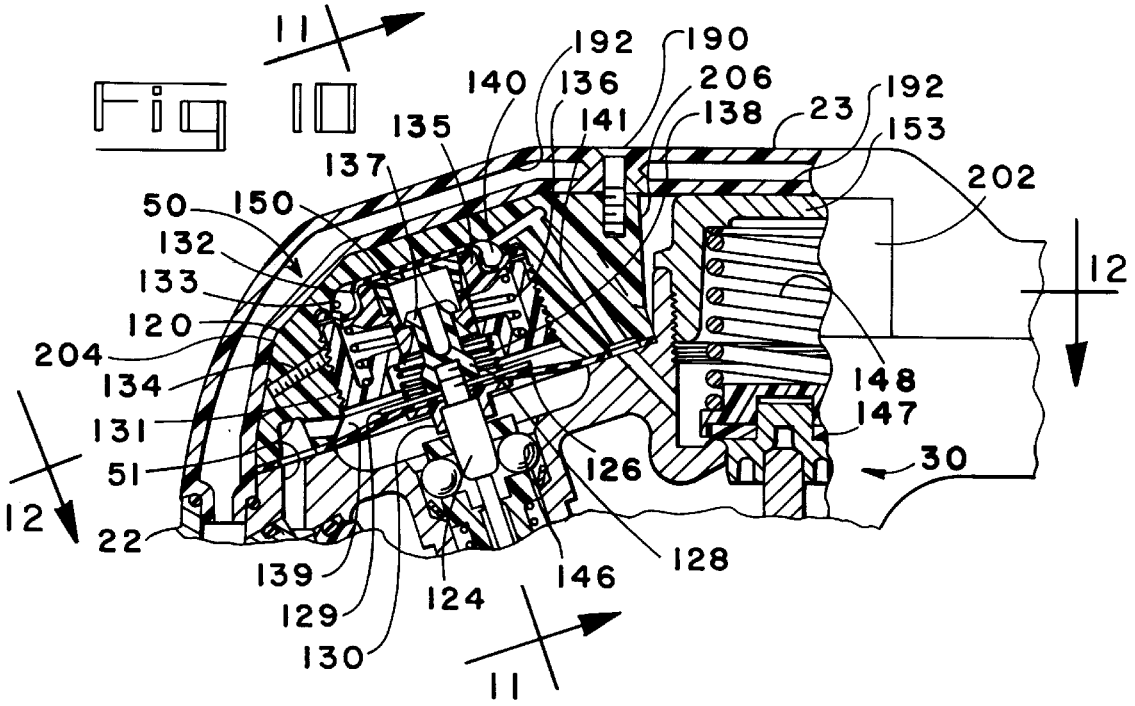
FIG. 10 is a longitudinal section illustrating the vacuum trip mechanism for causing closure of the nozzle's flow control valve.
Figure 11:
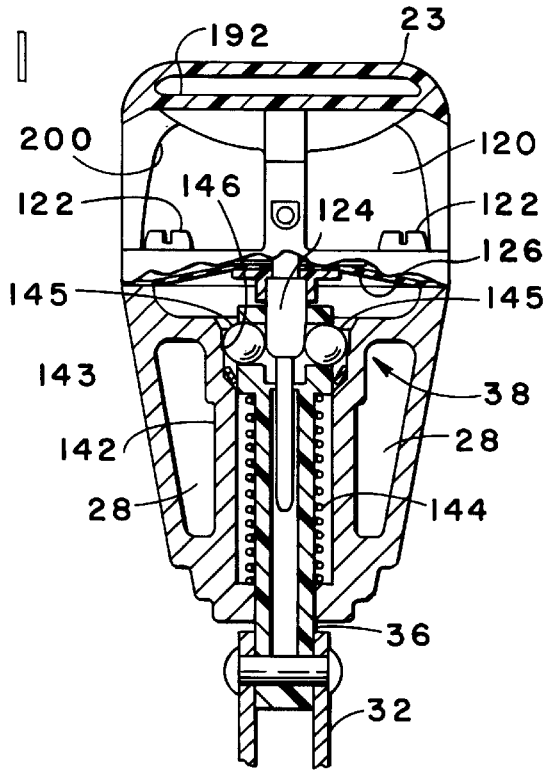
FIG. 11 is a section taken on line 11—11 in FIG. 10 and showing the trip mechanism connection to the operating lever.

In FIGS. 10 and 11 the trip mechanism 50 and latching mechanism 38 are shown in their release/unlatched positions, due to the fact that the fuel passage 28 is not pressurized upstream of the main valve 30, as will be more fully apparent from the following description.

Figure 12:
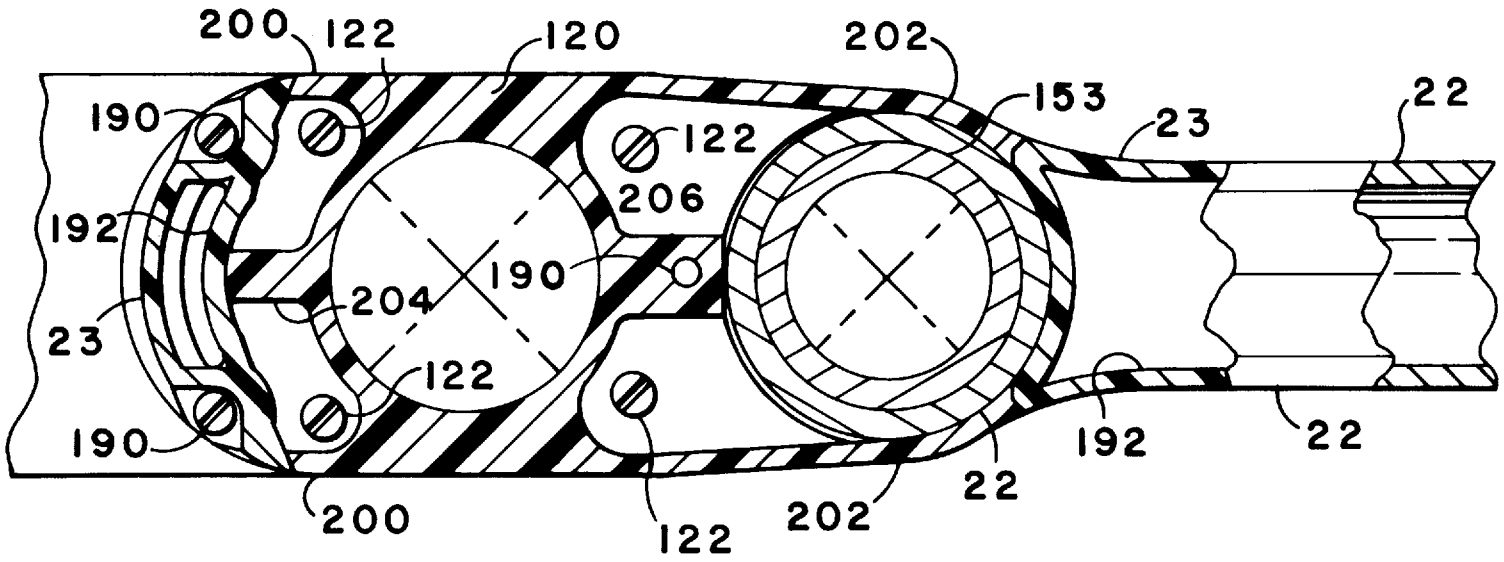
FIG. 12 is a section taken generally on line 12—12 in FIG. 10.

The trip mechanism 50 comprises a cap 120 which is mounted on an upper surface of the body member 22 by screws 122 (FIGS. 11 and 12). The output connection from the trip mechanism 50 to the latching mechanism 38 comprises a latch pin 124, which cooperates with the latching mechanism in a manner described below.

The latch pin 124 projects downwardly from a vacuum diaphragm 126 and has an upper end which is threaded into a connector 128. This threaded connection clamps washers 129, 130 against the upper and lower surfaces of the vacuum diaphragm 126. The outer peripheral edge portions of the vacuum diaphragm 126 are clamped between the cap 120 and the body member 22.

A support 131 is threaded into the cap 120 to clamp the peripheral edge portions of a pressure diaphragm 132 against a depending annular rib 133. A screw 134, threaded the cap 120, is provided to close a hole in the cap 120, which results from forming a passageway (141) later described. A diaphragm connector 135 underlies the pressure diaphragm 132. A spring 136 acting between the support 131 and the connector 135 urges the connector 135 to an upper position, limited by engagement of the central portion of the diaphragm 132 with the upper, inner surface of the cap 120.

Reference is again made to the latch pin connector 128. This connector comprises a pair of upstanding legs 137 which extend through a central opening in the pressure diaphragm connector 135. The legs 137 have shoulders which engage a surface of the connector 135, thereby providing abutment means which limit downward movement of the connector 128 relative to the connector 135. A spring 138, acting between the support 131 and the washer 129, urges the diaphragm 126, and latch pin 124, downwardly to a position defined by engagement of these abutment means.

The described structure defines a vacuum chamber 139 between the diaphragms 126 and 132. Also defined is a pressure chamber 140 between the diaphragm 126 and cap 120.

The vacuum chamber 139 is in fluid communication with the venturi chamber 44 via the previously referenced passage 51, which, as will be seen in FIG. 10, is compositely formed in the nozzle body member 22 and the cap 120.

The pressure chamber 140 is in fluid communication with the fuel passage 28, upstream of the valve 30. FIG. 10 illustrates that this communication is provided by a passageway 141 compositely formed in the body member 22 and the cap 120. The connector 135 has a central cap to which the pressure diaphragm 132 conforms, thereby defining the pressure chamber 140, as a continuous annular chamber, when the fuel passage 28 is depressurized.

The latching means 38 comprise the trip stem 36, which is slidably mounted in a tubular portion 142 of the body member 22, which spans the fuel passage 28 (FIG. 11). The trip stem 36 has an enlarged upper end 143, which is slidably received in a bore in the upper end of the tubular portion 142. The trip stem 36 is urged upwardly, in yielding engagement with a collar depending from the washer 130 by a spring 144.

The trip stem 36 is hollow and the latching pin 124 projects therein. Three balls 145 (two are diagrammatically shown) are mounted in radial holes in the enlarged end 143. The latching pin 124 maintains the balls 145 in outwardly projecting relationship from the enlarged portion 143, within a counterbore 146 formed at the upper end of the tubular portion 142.

The upper, or release position of the latching pin 124, seen in FIG. 10, is maintained by the spring 136, acting on the pressure diaphragm connector 135, through the connector 128 and the threaded connection with the latch pin 124. With the latching pin 124 in this release position, the trip stem 36 is free to move downwardly to a position in which the main valve 30 cannot be maintained in an open position. More specifically, the main valve 30 comprises a poppet member 147 which is normally maintained in a closed position by a spring 148. A spring cap 153 is removably threaded into the body member 22 to permit assembly of the main valve components and to restrain the spring 148 after assembly.

The poppet member 147 is opened by pivoting the lever 32 about its pivotal connection with the lower end of the trip stem, 36. In so doing, the valve stem is raised to open the poppet 147. Pivotal movement of the lever 32 exerts a downward force on the trip stem 36 (provided by the spring 148). With the latching pin 124 in its release position, the trip stem 36 moves downwardly, relative thereto. The balls 145 move downwardly relative to the latching pin 124, below its lower end. A cam seat is provided at the lower end of the counterbore 147, displaces the balls 145 inwardly of the diameter of the enlarged portion 143, permitting the trip stem to be displaced downwardly, so that the lever 32 will pivot about the valve stem 34, rather than about the trip stem 36. Note the slot connection (FIG. 1) with the pivot pin which connects the lever 32 and trip stem 36.

The foregoing generally describes what occurs when it is attempted to open the main valve 30, when the latching pin 124 is in its release position. Specifically, when the lever 32 is raised, the valve 30 remains closed, as the trip stem 36 is drawn downwardly by the lever 32 and pivots about the valve stem 34.

When the pressure chamber 140 is pressurized, the pressure connector 135 is displaced downwardly to a position, defined by its engagement with the support 131. When the pressure connector is in this position, the latch pin connector 128 is free to be displaced further downwardly to a latching position. Thus, when the lever 32 is raised, it initially pivots about the valve stem 34 and draws the trip stem downwardly. As the trip stem 36 is drawn downwardly, the latch stem follows with it and maintains the balls 145 in their outwardly projecting relation. The balls 145, being maintained outwardly, engage the lower end of the counterbore 146. The trip stem 36 is thus latched in an upper position, in which the lever is effective in opening the main valve poppet member 146. The lever 32 may be held in this raised, valve open position, by conventional means including the latching lever 37 (FIG. 1).

When the lever 32 is lowered, to deliberately stop fuel flow, the spring 148 closes the poppet 147. The spring 144 returns the trip stem 36 to its elevated position, with the latch pin remaining in telescoped relation therewith.

The trip mechanism provides means for returning the latching pin 124 to its release position, after delivery of fuel has been initiated, by opening the valve 30, as above described. When, the latching pin is displaced upwardly, to its release position, the balls 145 are free to be displaced inwardly so that the trip stem can be displaced downwardly and the poppet 147 displaced to its closed position by spring 148.

As indicated above, the inlet end 24 of the nozzle 20 is connected, via a hose and other conduit means to a fuel pump. The pump is, in turn controlled by known means (not shown) which enable the delivery of a predetermined amount of fuel in so-called prepay service stations. That is, a customer first pays a given amount for a given volume of fuel. The service station operator then sets a calculator which energizes the fuel pump. The amount of fuel delivered by the pump is metered. When there is about one fifth of a gallon of the prepaid amount yet to be delivered, the delivery rate is significantly reduced, from a normal delivery rate, say eight gallons per minute, to a greatly reduced rate of about one half gallon a minute. This reduction in delivery rate enables the pump to be accurately deenergized when the prepaid amount of fuel has been delivered. In effecting this reduction in delivery rate, the pressure of the fuel in the fuel passage 28 is substantially reduced.

In the context of this prepay system, the fuel passage 28, from the inlet 24 to the valve 30 is filled with fuel at zero gauge pressure until the pump and its computer are actuated by the service station operator. When the pump is actuated, this portion of the fuel passage is pressurized to the delivery pressure, representatively 25 psi. This pressure is transmitted through passage 141 to the pressure chamber 140. The diaphragm 132 and connector 135 are displaced downwardly, with the latter in engagement with the support 131.

At this point it will be noted that the connector 135, which is preferably formed as a molded, "structural" resin component, has a counterbore in its upper end. This counterbore facilitates provision of abutment means which are engageable with the latch pin connector legs 137. In order to minimize stresses on the diaphragm 132, a diaphragm support 150 is mounted in this counterbore. The diaphragm support 150 rests on the bottom of this counterbore and positions its upper surface generally in the plane of the upper surface of the connector 135.

With the pressure chamber 140 thus pressurized and the connector 135 in its lower operative position, the valve 30 may be opened by raising the lever 32, as above described. When the valve 30 is opened, there is an immediate increase in pressure downstream of the valve 30. This pressure overcomes the force of spring 104 and opens the venturi valve 42 for flow of fuel therethrough and discharge from the spout 26.

Flow of fuel through the venturi valve aspirates air into the fuel passage 28, through the passages 106. This air is drawn through the tube 64 and passage 110 to the chamber 44 so that there is but a minimal negative pressure generated in the chamber 44.

When the amount of fuel delivered approaches the prepaid amount, the pressure of fuel at the inlet end drops to 2½ psi during delivery of the final one fifth of a gallon of the prepaid amount. After the final amount has been delivered, the fuel pump is deenergized. Deenergization of the fuel pump results in a depressurization of the pressure chamber 140. When this occurs, the pressure diaphragm connector 135 is displaced upwardly and, acting through the latching pin connector 128, draws the latching pin 124 to its release position, whereupon the valve 30 closes.

If the prepaid amount of fuel exceeds the available capacity of the vehicle's fuel tank, fuel will rise in its fill pipe, blocking the entrance 48 to the venting passage 46 and thereby preventing further aspiration of air into the chamber 44. This results in a vacuum (negative pressure) in the vacuum chamber 139 which is sufficient to raise the latching pin 124 to its release position. The trip stem 36 is thus unlatched and the main valve 30 closed to terminate further flow of fuel.

It will also be noted that an orifice (not shown) may be provided in the venturi valve 96 to relieve pressurized fuel trapped between the main valve 30 and the venturi valve 96.

As fuel is being dispensed, vapors displaced from the fuel tank are captured into the spout 26 and returned, through the referenced vapor return passage 52, to the dual passage hose, connected to the inlet end of the nozzle body member 22. The portion of the vapor return passage through the spout 26 has already been described. It will be noted that the inlet 54 (holes 62) is disposed inwardly of the inlet 48 (hole 68) to the vent passage 46. As is evident from the above description, flow of fuel will be interrupted prior to the level of fuel reaching the inlet 52 for the vapor return passage. This arrangement minimizes, if not eliminates, liquid fuel in the vapor return passage.

The remainder of the vapor return passage 52 will now be described, with further reference to FIGS. 6–9.

The annular vapor passage defined by the tubes 56, 60, at the inner ends thereof, opens into a chamber 151, formed in the adapter 76. Vapors then flow into a vapor valve, inlet chamber 152 defined by the adapter 76 and the nozzle body member 22.

The vapor valve 55 comprises a housing 154 and an end cap 156, which are secured to a bottom surface of the nozzle body member 22, by screws, not shown. A poppet 158 is yieldingly maintained in engagement with a valve seat 160, formed in the housing 154, by spring 162. A stem 164, journaled in housing 154, depends from the poppet 158 and is connected to a diaphragm 166. The outer periphery of the diaphragm 166 is clamped between the housing 154 and end cap 156 and defines, in combination with the latter, a fuel pressure chamber 168.

As illustrated in FIGS. 6 and 9, the valve 55 is normally closed, when the nozzle 20 is not in use. The valve 55 is automatically opened in response to opening of the fuel valve 30. To this end, a compositely formed passage 170, extending through the nozzle body member 22, housing 154, diaphragm 166 and cap 156, connects the fuel passage 28 with the vapor valve chamber 168. Thus, when the fuel valve 30 is opened, the vapor valve 55 will automatically open so that there can be uninterrupted, vacuum assisted recovery of vapors, so long as fuel is being dispensed.

From the vapor valve 55, the vapor return flow passage 52 continues, past the valve seat 160, to a vertical passage 174, formed in the housing 154 and body member 22, then around a passage 176, compositely defined by the adapter 76 and the body member 22. The passage 176 opens into a body member passage 178. The vapor return passage then continues through the vapor cap 23, which overlies the major portion the nozzle body member 22, pursuant to the teachings found in U.S. patent application Ser. No. 430,713, filed Nov. 1, 1989, Donald L. Leininger, et al., which is of common assignment with the present application now issued as U.S. Pat. No. 5,121,777 .

The vapor cap 23 is secured to the body member 22, by a plurality of screws 190. The vapor cap is provided with a tubular extension 191, which is telescoped into the passage 178, to affect a connection with an internal passage 192, in the cap 23. The spout end of cap 23 has a width approximating that of the trip mechanism cap 120 and extends upwardly of front portion and then overlies the top of the cap 120. The vapor cap 23 then extends rearwardly, in overlying relation to the spring cap 153. The vapor cap then extends further rearwardly along the hand grip portion of the nozzle. The hand grip portion is of a generally circular cross section, being compositely formed by the vapor cap 23 and the body member 22, which respectively define portions of the vapor return passage 52 and the fuel passage 28.

The rearward end of the vapor cap 23 mates with an enlarged portion of the body member 22. At this interface, the vapor cap passage 192 communicates with a passageway 194 formed in the body member 22 (FIG. 1A). The rear end of the nozzle body member 22, at the inlet end 24 is provided with a fitting 195 for connection of the nozzle to a standard adapter, indicated by reference character A in FIG. 13, for attachment of a coaxial hose H. The coaxial hose comprises a fuel passage defined by a central hose and an annular vapor return passage defined by the central hose and an outer hose. The fuel passage 28 is placed in communication with the central hose and the pressurized fuel (fuel pump). The vapor return passage 52 is placed in communication with the annular vapor return passage and to the vacuum assist pump.

Figure 13:
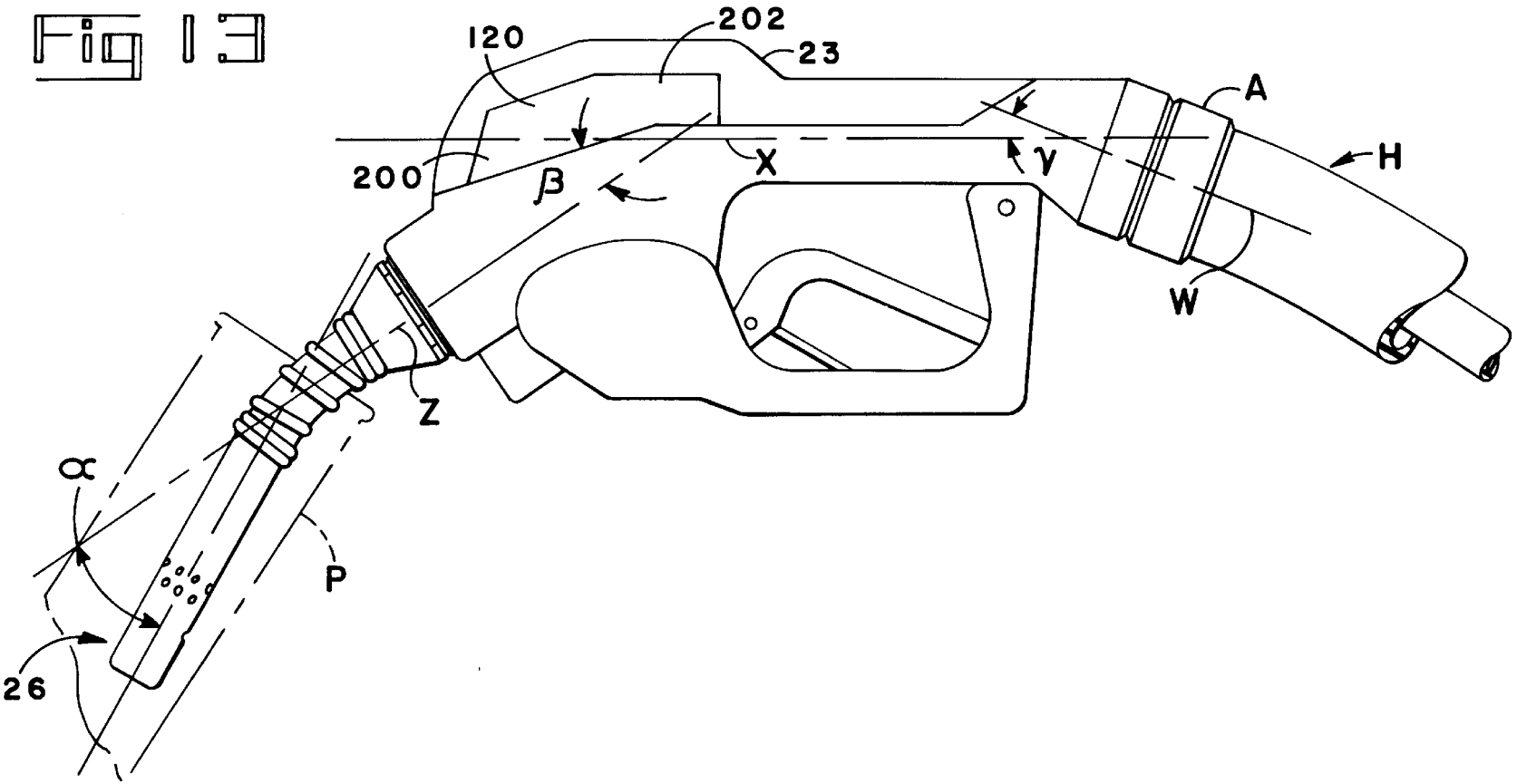
FIG. 13 is an elevation, on a reduced scale, of the nozzle seen in FIG. 1, illustrating further aspects of the invention.

The disposition of the trip mechanism 50 and main valve 30, relative to the fuel passage 28 and the vapor return passage 59 provides an advantageously compact nozzle. In achieving this end, the trip mechanism cap 120 and the spring cap 153 are angled away from each other and extend a relatively large distance above the main portion of the body member 22. In order to prevent there being an exterior opening, or gap, between these caps, the trip mechanism cap 120 is provided, on its opposite sides, with wings 200, 202 which extend forwardly and rearwardly of the nominal circular cross section of the cap 120 (FIGS. 12 and 13). The wings 202 extend rearwardly to embrace the poppet spring cap 153 and the body member boss into which it is threaded. The outer surfaces of these wings are generally in alignment with the adjacent surfaces of the vapor cap 23 and the body member 22. The side surfaces of the nozzle are thus compositely formed, in an uninterrupted fashion by the body member 22, the vapor cap 23 and the trip mechanism cap 120 and the wings 200, 202 thereof.

It will be noted that the wings 200, 202 are provided with forward, top and rear surfaces with which the vapor cap 23 mate. From FIGS. 10 and 12, it will be seen that the trip mechanism cap 120 has a forwardly projecting rib 204 which supports the adjacent portion of the vapor cap 23. A rearwardly projecting rib 206 provides further support for the vapor cap 23 as well as, optionally, receiving one of the vapor cap mounting screws 190. The vapor cap passage 192 is split around this mounting screw 190.

The discrete housing means for the trip mechanism 50 and the main valve 30 are thus incorporated in the nozzle body 21 in a manner in which one of the housing means forms a portion of the exterior surfaces of the nozzle body. In this context, it can be said that the nozzle body 21, in a primary structural sense, is compositely formed by the vapor cap 23, the trip mechanism cap 120 and the nozzle body member 22.

Reference is next made to FIG. 13, which illustrates the angular relationships between the connection with coaxial hose H and the discharge end of the spout 26. The spout is illustrated in its inserted relation with a vehicle, fuel tank, fill pipe P, during the dispensing of fuel. The angular disposition of vehicle tall pipes can vary to a considerable degree. The illustrated angle is representative of a more or less standard angle. In any event, for most vehicles, the fill pipe angle is such that axis X, of the hand grip portion of the nozzle body, will be generally horizontal when the axis Y of the discharge end of the spout 26 is disposed at an angle $\alpha$, of approximately 25° to the axis Z of the inner end portion of the spout and the axis Z is disposed at an angle $\beta$ of approximately 35° to the axis X.

The lengths of the nozzle portions defined by the axes X, Y and Z and the relative angles therebetween can vary to a relatively large degree to obtain the end of disposing the handle axis (X) in a generally horizontal position, when the nozzle is into the fill pipes of the majority of vehicles.

With this background in mind, it will be noted that the fitting 195 (for connecting the hose H, or a swivel and then the hose H) is formed on an axis W, which is angled downwardly from the axis X on an angle $\gamma$ of approximately 20°. This angular relationship of the axis for the fitting 195 achieves two, primary ends.

First, it directs the hose H in a downward direction. This points out that coaxial hoses are relatively stiff. Where a hose comprises only a fuel hose, it is relatively flexible and tends to drape toward the ground. When the nozzle is being inserted into and removed from a fill pipe, this draping, or drooping action, facilitates manipulation of the nozzle. The relative stiffness of coaxial hoses minimizes the extent to which they droop. By attaching coaxial hoses in the described, downwardly angled fashion, they are more readily manipulated in inserting and removing a vapor recovery nozzle from a fill pipe.

A second benefit of this arrangement stems from the fact that standard coaxial hoses have diameters substantially greater than those of hoses comprising only a fuel hose. It is possible, as illustrated herein, to provide a vapor recovery nozzle having a hand grip portion which has a cross section which is sufficiently small, so as to be comfortably gripped. However, at the nozzle inlet (24), the nozzle body (21) must have a substantially increased diameter in order to be connected to a standard coaxial hose or swivel. This results in the nozzle body and the hose or swivel, projecting above the hand grip portion, at its inlet end. Such projection has been found to be objectionable to nozzle users, giving, at least the impression that the nozzle is more cumbersome and difficult to deploy. The described angular disposition of the mounting adapter 195 enables the inlet end 24 of the nozzle body 21 (and the swivel or hose connected thereto) to be maintained at or below the level of the hand grip portion. A secondary benefit of this arrangement is that the nozzle has a visual appearance which has been found to be more aesthetically attractive.

The angle $\gamma$ is angle between axis W of the horizontal grip portion of nozzle and the axis of the hose attaching means 195. As indicated the hose H is a coaxial hose comprising a central fuel passage and an annular vapor return passage. The hose may be connected directly to the fitting 195, or a swivel may be connected to the fitting 185 and the hose then attached to the swivel. It is also to be appreciated that there are inverted coaxial hoses in which fuel flows through the annular chamber and vapor flows through the central passage. The fitting 195 and the connection of the fuel passage 28 and vapor return passage 52 thereto can be modified in an appropriate fashion.

The nozzle 20 is intended, primarily for operation in accordance with the teachings of U.S. Pat. No. 4,199,012—Lasater. This is to say that the nozzle is, preferably, intended for use in a fuel delivery system in which the vacuum source (pump), to which the vapor return passage 52 is connected, has sufficient capacity to draw air inwardly of a fill pipe and into the vapor return passage 52, during delivery of fuel. In addition to drawing vapors, displaced from the fuel tank, into the vapor return passage 52, an "air seal" is formed for preventing escape of vapors into the atmosphere.

Figure 14:
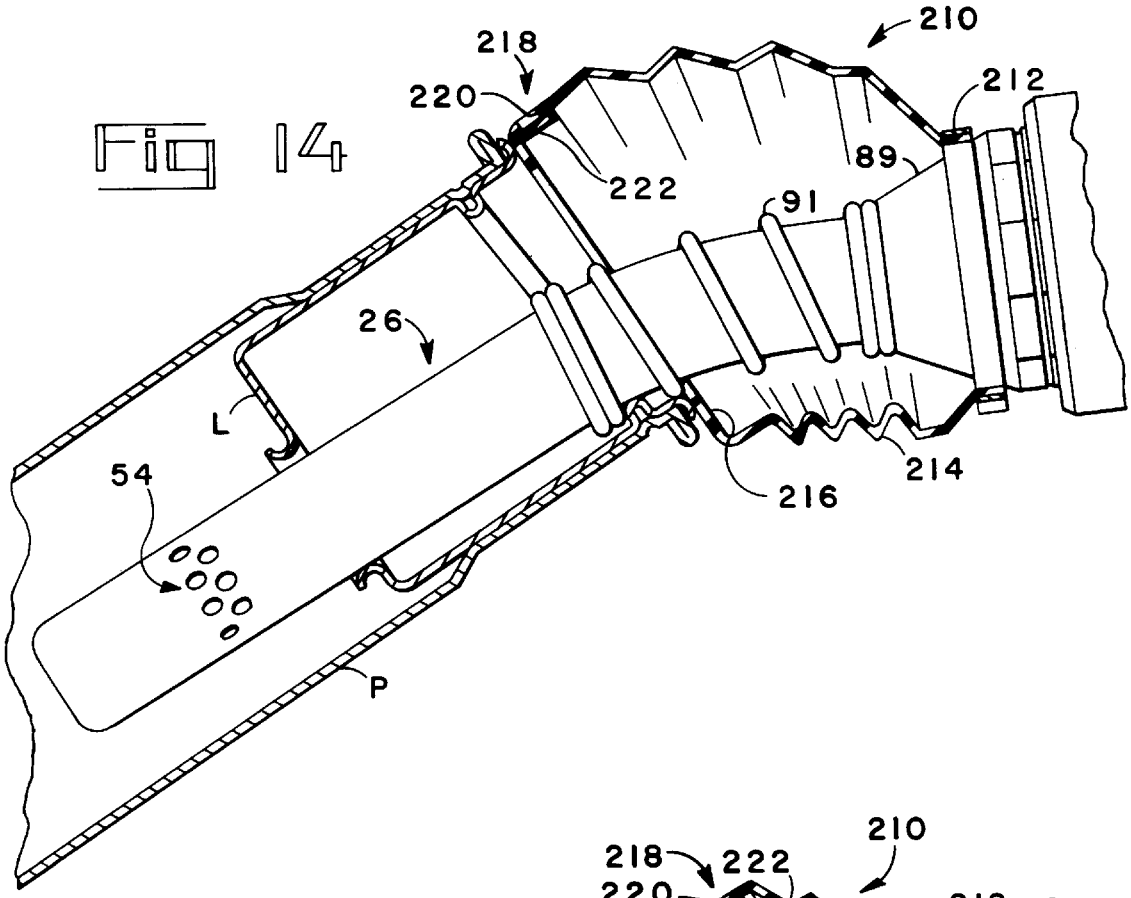
FIG. 14 is an elevation of the nozzle end portion of the present nozzle, illustrating its initial insertion into the fill pipe of a vehicle fuel tank, and a vestigial shroud engaging the fill pipe.
Figure 15:
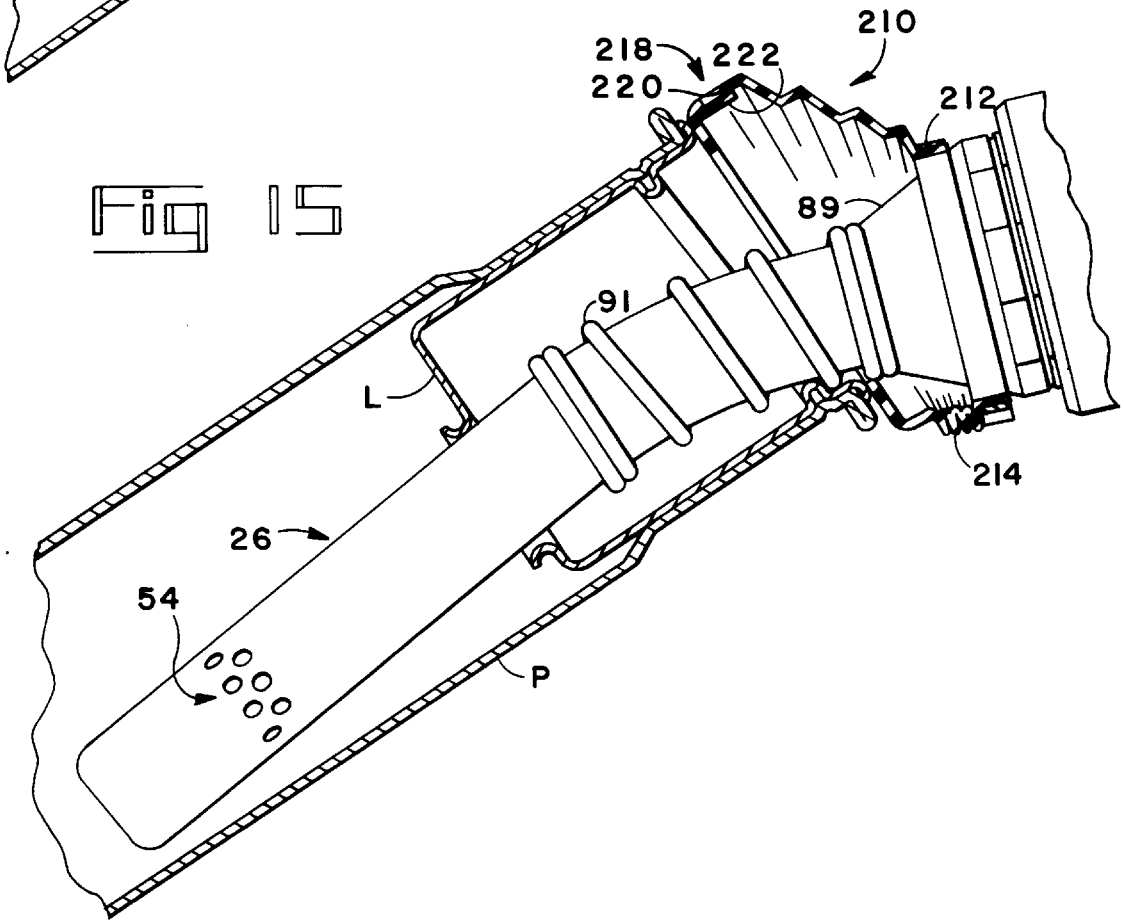
FIG. 15 is a view similar to FIG. 14, illustrating the nozzle spout fully inserted into the fill pipe.

For various reasons, the vacuum pump capacity, or negative pressure at the vapor passage inlet 54 may be insufficient to form an effective "air seal" interiorly of the fill pipe. To provide assurance that vapors will not escape into the atmosphere under such a circumstance, a vestigial shroud 210 may be provided as illustrated in FIGS. 14 and 15. The shroud 210 is clamped, at its inner end to the spout attaching nut 89, by a clamp 212. The shroud 210 is illustrated in its extended condition in FIG. 14, with the nozzle spout 26 inserted into a fill pipe P, which also comprises a "lead restrictor plate" L. The shroud 210 is formed of an elastomeric material and comprises a tubular bellows body portion 214 and an inturned, annular lip 216.

The shroud 210 is illustrated in its extended position in FIG. 14, with the spout 26 partially inserted into the fill pipe P. FIG. 15 illustrates the spout 26 fully inserted into the fill pipe P and the bellows portion compressed to yieldingly maintain the lip 216 in engagement with the outer end of the fill pipe P.

This vestigial shroud is distinguished from prior shrouds used in vacuum assist and pressure balance vapor recovery systems in several respects.

One of these distinctions is that the shroud 210 does not function to define any substantive portion of vapor return passage through the nozzle. This is to say that vapor return passage 52 is defined, from the inlet 54, internally of the spout 26 and then internally of the nozzle body 21. The shroud, while its function is similar to prior shrouds, provides means for assuring that vapors will enter the vapor return passage 52, rather than forming a part of that passage.

Another distinction is found in the fact that only a relatively light pressure is required between the lip 216 and the fill pipe P. Further, a mechanical, or positive seal is not desired. This is to point out that it is contemplated that there will, at all times, be a negative pressure in the return passage 52, creating some degree of negative pressure in the upper end of the fill pipe P. This negative pressure will tend to collapse the bellows portion 214 to the end that the lip 216 will be drawn into engagement with the fill pipe P. It is intended that there be some leakage and flow of atmospheric air between the lip 216 and fill pipe to reduce the air flow cross section and create an "air seal" as opposed to a positive, mechanical seal. This end may be provided by forming the lip with a roughened surface, of by forming one or more grooves in the lip.

A further distinction of the present vestigial shroud 210, over sealing shrouds of balance vapor return systems, is that it has a relatively short length, preferably no greater than about one third the length of the spout. The short length of the shroud 210 leaves the major portion of the spout visible, thereby facilitating its insertion into a fill pipe. This advantage stems from the light sealing pressure required between the lip and the fill pipe. The light engagement pressure requirement has the further advantage of minimizing the weight of the vestigial shroud 210. Additionally, the light engagement pressure requirement makes it much easier to use the nozzle. That is the shroud 210 present only minimal resistance to full insertion of the spout 210 into the fill pipe, to the end that there is no need to provide interlock means for preventing operation of the nozzle, as a function of a predetermined shroud sealing pressure.

The vestigial shroud 210 may also be provided with a check valve 218, (alternately a small orifice could be used) to bleed atmospheric air into the fill pipe, should a positive seal be created between the shroud and the fill pipe. This prevents an excessive negative pressure, which could cause collapse of the fuel tank, or some other component of the fuel delivery system.

Such a check valve could take the simple form of an opening 220 in the bellows portion 214 and an integrally molded flap 222. The resilience of the shroud material is sufficient to hold the flap 222 in a position normally closing the opening 220. When the interior negative pressure exceeds such predetermined value, the flap is deflected to a position permitting air to pass through the hole 220 and limit the negative pressure.

Figure 16:
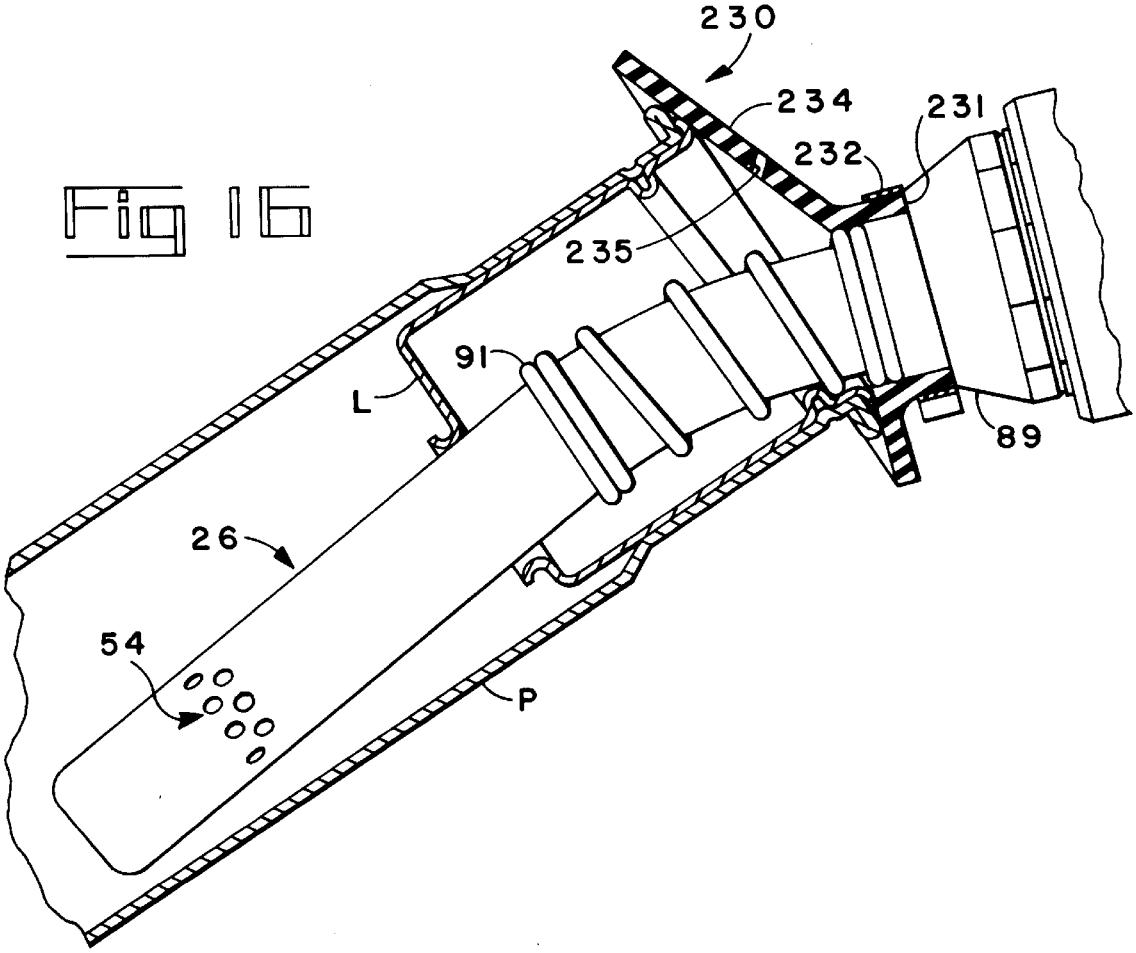
FIG. 16 is a view similar to FIG. 14, illustrating an alternate, vestigial shroud construction.
Figure 17:
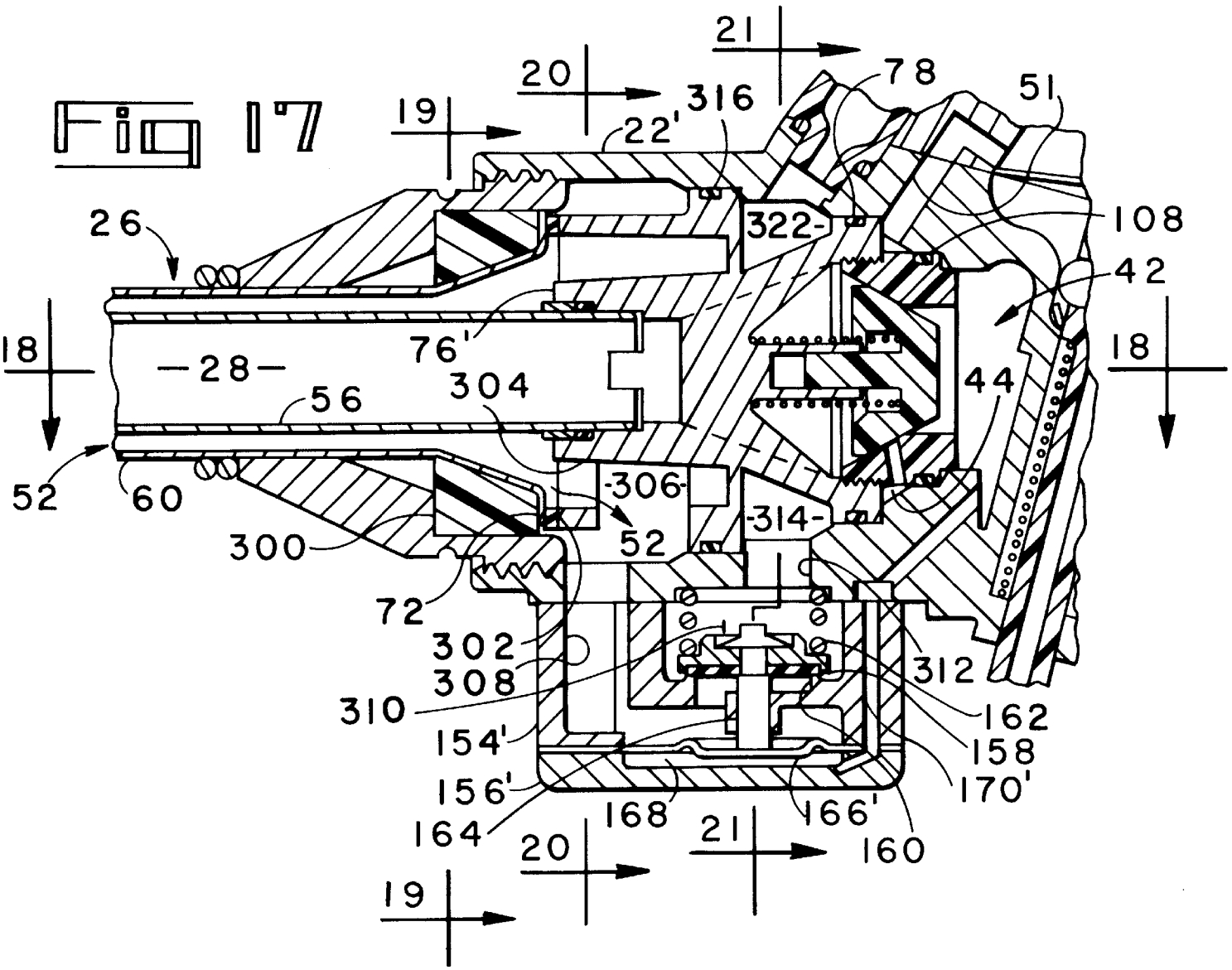
FIG. 17 is a longitudinal section similar to FIG. 6 illustrating an alternate construction of the invention, particularly as relates to a modified vapor valve.

FIG. 16 is illustrates an alternate vestigial shroud 230 having a tubular collar 231 at its inner end which is telescoped over and the spout mounting nut 89 and secured by a band clamp 232. The shroud 230 further comprises a flared skirt 234. In FIG. 16, the spout 26 is illustrated in its fully inserted position in a fill pipe P, as previously described. In this position, the skirt 234 has been deflected rearwardly and its outwardly facing surface is maintained in sealing engagement with the end of the fill pipe P by the resilience of the elastomeric material employed in forming the shroud 230.

In referencing "sealing forces", it is to be understood, that, as in the previous vestigial shroud 210, it is not desired to obtain a "positive" or "mechanical" seal, since that type of seal could result in a vacuum force capable of comprising the integrity of the fueling system components. The surface of the skirt 234 may be roughened so that and "air seal" will be attained without creating a positive seal. Alternatively, a bleed hole 235 can be provided in the skirt 234, so that the seal between the vestigial shroud 230 will not be a "positive" seal.

It will be observed that, in the type of fill pipe illustrated, the spout, when inserted therein, is disposed eccentrically thereof. That is, the spout is disposed toward the lower portion of the outer end of the fill pipe. The skirt 234 has a generally circular outline, or outer periphery. In order to obtain an effective seal it is preferred that the tubular collar be similarly eccentric to the circular outline of the skirt 234. The outwardly flared length of skirt 234, from the collar 231 thus varies from a minimum distance at its bottom to a maximum distance at its top. The thickness of the skirt, and/or its initial angle, are, preferably, varied so that the sealing force with the fill pipe will be essentially uniform circumferentially of the fill pipe.

The vestigial shroud 230 has a configuration similar to so-called "splash guards" employed in non-vapor recovery nozzles. In using a non-vapor recovery nozzle, there is the possibility that, as fuel rises in the fill pipe, and before the automatic shut-off mechanism is actuated, that the force of fuel being discharged can cause fuel to be splashed upwardly, out of the fill pipe. Splash guards are a conventional means, which act as a baffle, to deflect the splashed fuel and prevent it from being directed axially of the spout and impinging on the user of the nozzle.

The vestigial shroud 230 is functionally and structurally distinguished from such splash guards by reason of the fact that it forms an air seal with the outer end of the fill pipe P to prevent escape of vapors. In contrast, non-vapor recovery nozzles, displace vapors from the vehicle fuel tank as fuel is discharged therein. This displaced fuel generates a positive pressure in the fill pipe. Such displaced fuel, necessarily, must escape from the fill pipe. Splash guards are not intended to have, nor would it be safe for splash guards to have a sealed relation with the outer end of the fill pipe. Even though the vestigial shroud 230 does provide splash protection, it functions to assure that vapor will not escape into the atmosphere—the opposite result of conventional non-vapor recovery nozzles employing splash guard.

The vestigial shrouds 210 and 232 are deflected to obtain, the desired engaged relationship with the fill pipe P, by insertion of the spout into the fill pipe. As indicated, this engagement force is relatively low since the negative pressure from the vapor return path of the nozzle assists in providing the desired "air seal". Those skilled in the art will be readily able to select an appropriate elastomer, such as neoprene, for the shroud and proportion the deflected portions of the shrouds to provide an effective sealing force.

Alternate Embodiment (FIGS. 17–21)

The alternate construction of FIGS. 17–21 primarily involves a preferred modification of the vapor valve, which in these figures is indicated by reference character 55'. The vapor valve 55' varies from the vapor valve 55 with regard to the associated passages by way of which vapor flows to and from the valve element.

Several components of this embodiment are identical with components in the prior embodiment and are identified by like reference characters. Other components are modifications of components found in the previous embodiment and are identified by like reference characters which have been primed. Where a component performs the same function as in the previous embodiment it may be shown, with or without a reference character identification, and its purpose or function not repeated.

The basic components of this embodiment involve the connection of a spout 26 on a nozzle body member 22' and related structure which define the portions of the vapor return flow path 52 to and from the vapor valve 55'.

The spout 26 comprises an outer tube 60 and an inner tube 56 which define portions of a central fuel passage 28 and an annular vapor return passage 52. The spout is mounted on the nozzle body member 22' by a breakaway, spout mounting nut 89, which clamps a flange 72 on the outer tube 56 against an adapter 76' through a spacer 300 and sealing ring 302. The length of the body member 22' has been extended relative to the adapter 76'. The function of the spacer 300 is to permit use of the same spout 26, as before described.

Figure 18:
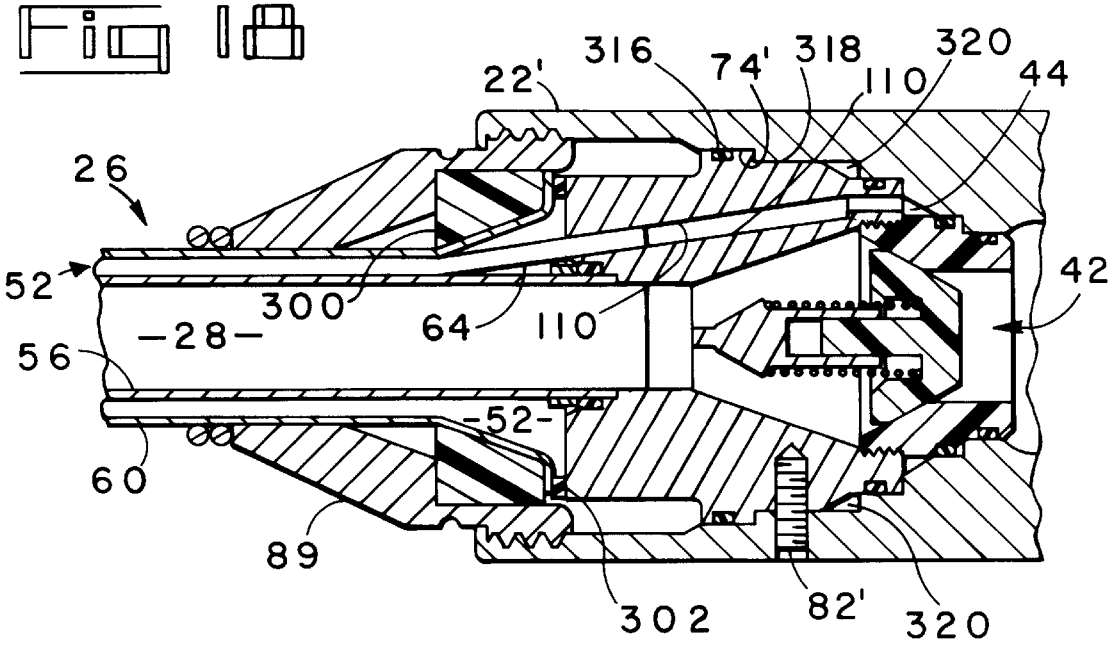
FIG. 18 is a section taken on line 18—18 in FIG. 17.
Figure 19:
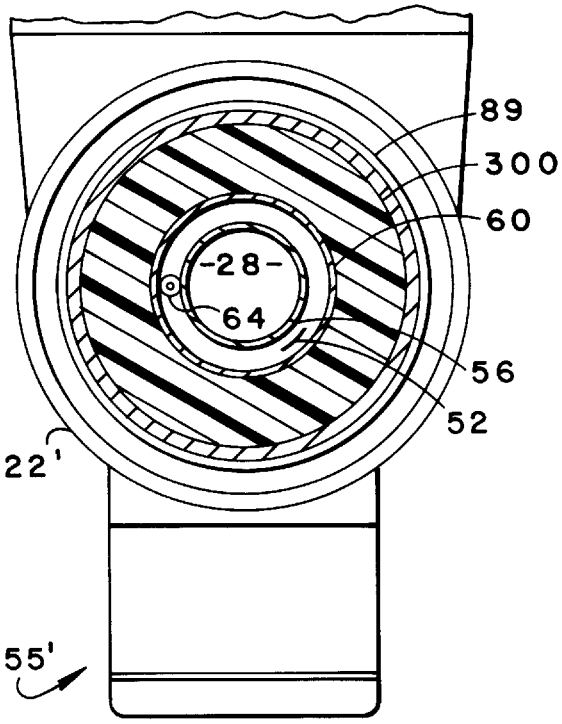
FIG. 19 is a section taken on line 19—19 in FIG. 17.

The fuel flow passage 28 continues through the adapter 76', as before described, with a venturi valve 42 mounted at its upstream end. As before, flow of fuel through the venturi valve 42 generates a negative pressure in an annular vacuum chamber 44. The chamber is normally vented to atmosphere through a vent tube 64 (FIG. 18). When the inlet to this tube is block by fuel in a fill pipe, the resultant increase in negative pressure actuates the automatic shut off mechanism.

Figure 20:
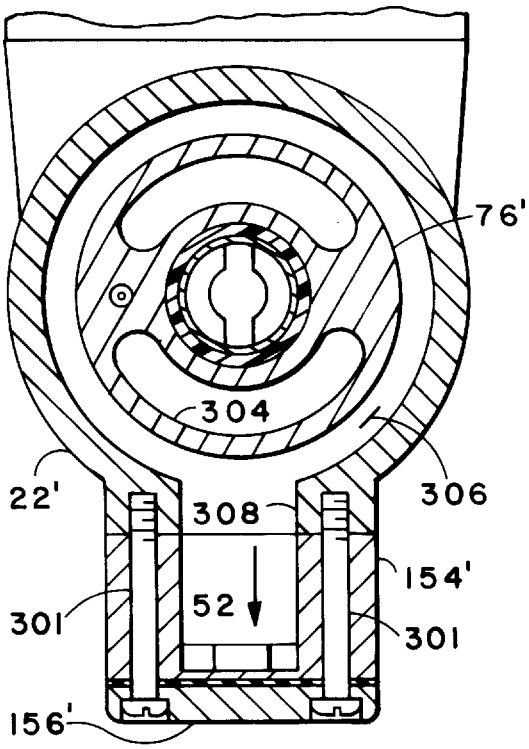
FIG. 20 is a section taken on line 20—20 in FIG. 17.

The vapor valve 55' comprises a housing 154' and an end cap 156' which are secured to the undersurface of a nozzle body member 22' by screws 301, see FIG. 20. The valve 55' comprises a poppet 158, which is yieldingly maintained in engagement with a valve seat 160, formed in the housing 154', by spring 162. A stem 164, journaled in housing 154', depends from the poppet 158 and is connected to a diaphragm 166'. The outer periphery of the diaphragm 166' is clamped between the housing 154' and end cap 156' and defines, in combination with the latter, a fuel pressure chamber 168.

As before, the vapor valve 55' is normally closed. When delivery of fuel is initiated, by opening main valve 30, the chamber 168 is pressurized, through a passage 170, compositely formed in the nozzle body member 22', valve housing 154'. diaphragm 166' and end cap 156'. The poppet 158 is thus raised to open the vapor valve 55'.

This leads to a description of the vapor return flow path to and from the vapor valve 55'. Vapor flows inwardly of the spout 26 through the annular passage defined by the tubes 56, 60, and then, through an arcuate opening 304, in the adapter 76', to an annular chamber 306. A passage 308, compositely formed in and by the body member 22', housing 154' and diaphragm 168', leads to the underside of the poppet 158 and provides the portion of the vapor flow path 52, leading to the vapor valve 55'.

At this point, there will be a brief digression to describe the mounting of the adapter 76' in the nozzle body member 22'. The nozzle body member 22' has a stepped, multi-diameter bore 74', which receives the adapter 76', to which the venturi valve 42 is attached before assembly. The annular, vacuum chamber 44 is sealed at its downstream and upstream ends by O-rings 78 and 108. The portion of the vapor return flow path from the vapor valve 55', to the upper side of the body member 22', is between a further O-ring seal 316 and the O-ring seal 78. A pair of horizontal arms 318 (FIG. 21) extend from the central portion of the adapter 76' the multi-diameter bore in the body member 22. A bore 110 extends through one of the arms 318 to provide fluid communication between the vent tube 64 and the annular vacuum chamber 44. A retaining screw 82' extends through the body member 22' and into the other arm 318 to angularly position the adapter 76' relative to the body member 22'.

Figure 21:
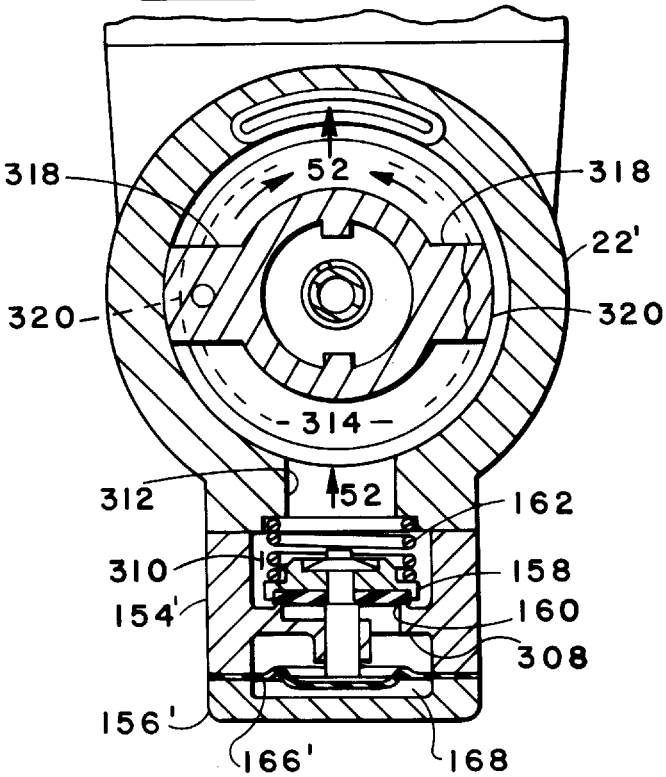
FIG. 21 is a section taken on line 21—21 in FIG. 17.

Vapor return flow (52) from the chamber 314 passes through triangular passages 320, FIGS. 18, 21, at the upstream ends of the adapter arms 318, into an upper chamber 322. Vapor return flow passes from the chamber 322 through a passage 170 to the vapor return cap 23.

One advantage of the vapor valve 55' is that the vapor return flow to this valve is more positively sealed from the discharge flow therefrom (by the O-ring seal 316. This is of particular importance when the nozzle 20 is not being employed to deliver fuel and the valve 55' is closed. Under this condition, the vapor return flow path, upstream of the valve 55' remains connected to the vacuum source. If there is leakage flow between the inlet to and the discharge flow path from the vapor valve, then there will be a drain on the vacuum source which draws vapors for return to the storage tank, which reduces its effectiveness in providing a negative pressure for other vapor return nozzles employing the same, common vacuum pump.

It will also be appreciated that various features of the present invention can be used independently of one another, as well as finding advantage in when used in the disclosed nozzle, wherein the several features combine to provide advantages over prior fuel nozzles.

Thus there will be variations from the disclosed embodiment, which will occur to those skilled in the art, within the scope and spirit of the present inventive concepts that are defined in the following claims.

In the claims, terms such as "upper" and "lower" are used, for purposes of reduced prolixity, with reference to the orientation of nozzle as illustrated and described. For the same purpose, the terms "upstream" and "downstream" reference the direction of fuel flow and "discharge end" references the distal end of the spout, from which fuel is discharged.

Having thus disclosed the invention, what is claimed as novel and desired to be secured by Letters Patent of the United States:

1. A vapor recovery, automatic shut off, fuel dispensing nozzle comprising a nozzle body, a spout projecting from a downstream end of the nozzle body, fuel passageway means extending from an inlet end of the nozzle body to a discharge end of the spout, vapor return passageway means, including a portion extending lengthwise of the spout, shut off means for automatically terminating flow of fuel through the fuel passageway means in response to fuel reaching the level of the spout when the spout is inserted in a fuel tank, fill pipe, said shut off means including a vent passageway extending lengthwise of the spout, with one end of the vent passageway terminating adjacent the discharge end of the spout to provide communication with atmosphere, wherein the portion of the fuel passageway means in the spout is essentially free of turbulence generators, and the vent passageway is separate from the vapor return passageway means and is disposed laterally outwardly of the portion of the fuel passageway means through the spout, the vent passageway has an entrance opening at the distal end portion of the spout, and the vapor return passageway means has an inlet opening, at the distal end portion of the spout, spaced from the vent passageway entrance opening, wherein the spout comprises an inner tube defining a portion of the fuel passageway, and an outer tube defining, in combination with the inner tube, the portion of the vapor return passageway means, which extends lengthwise of the spout, the vent passageway is provided, at least in part, by a vent tube, and the vent tube is disposed between the inner and outer spout tubes, and wherein a ferrule joins the distal ends of the inner and outer tubes, and further characterized in that the ferrule has a longitudinal slot, and the vent tube is disposed in the longitudinal slot in the ferrule, and an opening in the outer tube places the outer end of the vent tube in fluid communication with the exterior of the spout.

2. A vapor recovery, automatic shut off fuel dispensing nozzle comprising a nozzle body, a spout projecting from a fuel discharge end of the nozzle body, fuel passageway means and vapor return passageway means extending, respectively, between an inlet end of the nozzle body and a distal, discharge end of the spout, said vapor return passageway means, at the inlet end of the nozzle body, being adapted for connection with a vacuum source for drawing vapors from the spout end of the nozzle to a remote disposal site, a vapor valve interposed in the vapor return passageway means, said vapor valve being closed excepting when there is fuel flow through the fuel passageways means, means for automatically terminating flow of fuel through the fuel passageway means in response to fuel reaching the level of the spout when the spout is inserted in a fuel tank, fill pipe, said shut off means including a vacuum chamber disposed in the nozzle body, and venting passageway means extending from the vacuum chamber to the discharge end of the spout, wherein the venting passageway means and the vapor return passageway means are sealed from each other, the venting passageway means has an entrance opening at the distal end portion of the spout, and the vapor return passage has an inlet opening, at the distal end portion of the spout, spaced from the venting passage entrance opening, and further wherein the nozzle body comprises a hand grip portion, and the fuel passageway means and vapor return passageway means extend from said inlet end through said hand grip portion, and the vapor return passageway means extend from the spout to the vapor valve and then from the vapor valve to the portion of the vapor return passageway means in the hand grip portion, the nozzle body has a bore in a fuel discharge end thereof, and an adapter disposed in said bore in the nozzle body, and further characterized in that the adapter, in combination with said nozzle body defines portions of said vapor return passageway means leading to the vapor valve and from the vapor valve to an entrance to the vapor return passageway means in said hand grip portion.

3. A vapor recovery, automatic shut off fuel dispensing nozzle as in claim 2, wherein the spout comprises an inner tube defining a portion of the fuel passageway means, and an outer tube defining, in combination with the inner tube, a portion of the vapor return passageway means, which extends lengthwise of the spout, further wherein the portion of the venting passageway means, extending through the spout, is provided by a vent tube and the vent tube is disposed between the inner and outer spout tubes, the fuel passage way means include a fuel bore extending longitudinally through the adapter, the venting passageway means comprise a vent passage in the nozzle body and a vent passage in the adapter, and further characterized in that the inner end of the vent tube is telescopingly sealed with the adapter vent passage, and the inner end of the inner spout tube is telescopingly sealed with said fuel bore through the adapter.

4. A vapor recovery, automatic shut off fuel dispensing nozzle as in claim 3, further characterized in that the adapter vent passage is laterally offset from the fuel passage through the adapter and is angled relative thereto, the inner tube has a generally uniform wall thickness and is generally coaxial with the outer tube, the diameter of the vent tube approximates the annular spacing between the inner and outer tubes, the outer tube has a generally uniform wall thickness through out its length, the inner end of the outer tube comprises an outwardly flared, conical section, and the inner end of the vent tube is angled outwardly to be telescoping received in the vent passage of the adapter.

5. A vapor recovery, automatic shut off, fuel dispensing nozzle as in claim 4, wherein the spout is angled downwardly from the nozzle body, said nozzle, when viewed from the spout end, has said spout in a lower, six o'clock position, further characterized in that the distal end of the vent tube is disposed at the lower portion of the spout in the six o'clock position, the adapter vent passage is disposed above the lower portion of the spout, and the vent tube is coiled within the spout from the six o'clock position to a higher position at the adapter.

6. A vapor recovery, automatic shut off, fuel dispensing nozzle as in claim 4, wherein further characterized in that the inner end of the outer spout tube comprises a radial flange extending outwardly of the conical portion, and breakaway nut means engage said flange to mount said spout on the nozzle body.

7. A vapor recovery, automatic shut off fuel dispensing nozzle as in claim 2, further characterized in that O-ring sealing means, effective between said adapter and said bore, isolate the vapor return passage from the vacuum chamber.

8. A vapor recovery, automatic shut off fuel dispensing nozzle as in claim 7, wherein the vapor valve comprises a housing, a poppet member mounted in the housing, and yieldable means maintaining the poppet member in a closed position, said valve housing including an inlet, in communication with the vapor return passage means from said spout, said inlet directing vapor in a downward direction to said poppet member, and an outlet extending from beneath the poppet member, laterally and upwardly for communication with the portion of the vapor return passageway means extending to the entrance to the hand grip portion of the vapor return passage.

9. A vapor recovery, automatic shut off fuel dispensing nozzle as in claim 7, further characterized in that the portion of the vapor return passageway means leading to the vapor valve is compositely defined by said adapter and said body member, downstream of the portion of the vapor return passageway means extending away from said vapor valve, and O-ring sealing means, effective between said adapter and said bore, isolate the vapor return passageway means leading to said vapor valve from the vapor return passageway means extending away from said valve.

10. A vapor recovery, automatic shut off fuel dispensing nozzle as in claim 9, wherein the vapor valve comprises a housing, a poppet member mounted in the housing, and yieldable means maintaining the poppet member in a closed position, said valve housing including an inlet, in communication with the vapor return passageway means from said spout, said inlet being disposed in longitudinal alignment with the poppet member downstream thereof and directing vapor in a downward direction and then to said poppet member for flow of vapor upwardly past said poppet, and an outlet extending from the upper side of the poppet member, for communication with the portion of the vapor return passageway means extending to the entrance to the hand grip portion of the vapor return passageway means.

11. A spout subassembly for a vapor recovery, automatic shut off, fuel dispensing nozzle, said spout subassembly comprising an inner tube defining a fuel passageway, and an outer tube defining, in combination with the inner tube, a vapor return passageway, which extends lengthwise of the spout, wherein the fuel passageway in the spout is essentially free of turbulence generators, and a vent passageway separate from the vapor return passageway, disposed laterally outwardly of the fuel passageway, provided by a vent tube disposed between the inner and outer spout tubes, wherein a ferrule joins the distal ends of the inner and outer tubes, and further characterized in that the ferrule has a longitudinal slot, and the vent tube is disposed in the longitudinal slot in the ferrule, and an opening in the outer tube places the outer end of the vent tube in fluid communication with the exterior of the spout.

* * * * *